US008010007B2

(12) United States Patent
Sano et al.

(10) Patent No.: US 8,010,007 B2
(45) Date of Patent: Aug. 30, 2011

(54) IMAGE FORMING APPARATUS INCLUDING A PLURALITY OF HEATING UNITS AND METHOD OF CONTROLLING THE SAME

(75) Inventors: Takeshi Sano, Kanagawa (JP); Norikazu Okada, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 363 days.

(21) Appl. No.: 12/232,147

(22) Filed: Sep. 11, 2008

(65) Prior Publication Data

US 2009/0074442 A1 Mar. 19, 2009

(30) Foreign Application Priority Data

Sep. 14, 2007 (JP) ..... 2007-239457

(51) Int. Cl.
*G03G 15/20* (2006.01)

(52) U.S. Cl. ..... 399/69; 399/88

(58) Field of Classification Search ..... 399/69, 399/88

See application file for complete search history.

(56) References Cited

U.S. PATENT DOCUMENTS 6,301,454 B1 * 10/2001 Nishida et al. ..... 399/69
6,807,386 B2 * 10/2004 Yasui et al. ..... 399/69

FOREIGN PATENT DOCUMENTS

JP 2003-217793 7/2003
JP 2005-250447 9/2005
JP 4066410 1/2008

OTHER PUBLICATIONS

Abstract for JP 2003-323085 published Nov. 14, 2003.

* cited by examiner

*Primary Examiner* — Ryan D Walsh
(74) *Attorney, Agent, or Firm* — Harness, Dickey & Pierce

(57) ABSTRACT

A control unit controls supply of power to a plurality of heating units at predetermined control period T1 that is set by a first unit. A second unit sets power supply time t1 for a first heating unit having largest power consumption within the control period T1 and power supply time t2 for a second heating unit having second largest power consumption. A third unit controls to supply the power to the first heating unit for the power supply time t1 from beginning of the control period T1 and to supply the power to the second heating unit from a point obtained by subtracting the power supply time t2 from end of the control period T1 to the end of the control period T1.

11 Claims, 18 Drawing Sheets

FIG. 15

※MAINLY USED FOR WARM-UP

| | | HEATER RATED POWER [W] | | | |
|---|---|---|---|---|---|
| REFERENCE POWER | | HEATING CENTER | HEATING ENDS | PRESSING | TOTAL |
| 1420W | | 673 | 539 | 270 | W |
| LEVEL | USABLE POWER | TURN-ON DUTY | | | POWER IN USE |
| 0 | 550 | 39% | 39% | 30% | 554 |
| 1 | 575 | 41% | 41% | 30% | 578 |
| 2 | 600 | 43% | 43% | 30% | 602 |
| 3 | 625 | 45% | 45% | 30% | 626 |
| 4 | 650 | 47% | 47% | 30% | 651 |
| 5 | 675 | 49% | 49% | 30% | 675 |
| 6 | 700 | 51% | 51% | 30% | 699 |
| 7 | 725 | 53% | 53% | 30% | 723 |
| 8 | 750 | 55% | 55% | 30% | 748 |
| 9 | 775 | 57% | 57% | 30% | 772 |
| 10 | 800 | 59% | 59% | 30% | 796 |
| 11 | 825 | 61% | 61% | 30% | 820 |
| 12 | 850 | 63% | 63% | 30% | 845 |
| 13 | 875 | 65% | 65% | 30% | 869 |
| 14 | 900 | 67% | 67% | 30% | 893 |
| 15 | 925 | 69% | 69% | 30% | 917 |
| 16 | 950 | 71% | 71% | 30% | 942 |
| 17 | 975 | 73% | 73% | 30% | 966 |
| 18 | 1000 | 75% | 75% | 30% | 990 |
| 19 | 1025 | 77% | 77% | 30% | 1014 |
| 20 | 1050 | 80% | 80% | 30% | 1051 |
| 21 | 1075 | 80% | 80% | 39% | 1075 |
| 22 | 1100 | 80% | 80% | 48% | 1099 |
| 23 | 1150 | 80% | 80% | 66% | 1148 |

FIG. 16

※MAINLY USED DURING PAPER FEEDING

| | | HEATER RATED POWER [W] | | | |
|---|---|---|---|---|---|
| REFERENCE POWER | | HEATING CENTER | HEATING ENDS | PRESSING | TOTAL |
| 1420W | | 673 | 539 | 270 | W |
| LEVEL | USABLE POWER | TURN-ON DUTY | | | POWER IN USE |
| 0 | 550 | 58% | 29% | 0% | 547 |
| 1 | 575 | 61% | 31% | 0% | 575 |
| 2 | 600 | 63% | 32% | 0% | 594 |
| 3 | 625 | 66% | 33% | 0% | 622 |
| 4 | 650 | 69% | 35% | 0% | 650 |
| 5 | 675 | 71% | 36% | 0% | 669 |
| 6 | 700 | 74% | 37% | 0% | 697 |
| 7 | 725 | 76% | 38% | 0% | 716 |
| 8 | 750 | 79% | 40% | 0% | 745 |
| 9 | 775 | 82% | 41% | 0% | 773 |
| 10 | 800 | 84% | 42% | 0% | 792 |
| 11 | 825 | 87% | 44% | 0% | 820 |
| 12 | 850 | 90% | 45% | 0% | 848 |
| 13 | 875 | 92% | 46% | 0% | 867 |
| 14 | 900 | 95% | 48% | 0% | 895 |
| 15 | 925 | 98% | 49% | 0% | 924 |
| 16 | 950 | 100% | 50% | 0% | 943 |
| 17 | 975 | 100% | 50% | 0% | 943 |
| 18 | 1000 | 100% | 50% | 20% | 997 |
| 19 | 1025 | 100% | 50% | 30% | 1024 |
| 20 | 1050 | 100% | 50% | 40% | 1051 |
| 21 | 1075 | 100% | 50% | 49% | 1075 |
| 22 | 1100 | 100% | 50% | 58% | 1099 |
| 23 | 1150 | 100% | 50% | 77% | 1150 |

FIG. 17

※MAINLY USED FOR STANDBY

| | | HEATER RATED POWER [W] | | | |
|---|---|---|---|---|---|
| REFERENCE POWER | | HEATING CENTER | HEATING ENDS | PRESSING | TOTAL |
| 1420W | | 673 | 539 | 270 | W |
| LEVEL | USABLE POWER | TURN-ON DUTY | | | POWER IN USE |
| | 625 | 45% | 45% | 30% | 625 |

FIG. 18

| MAJOR CLASSIFICATION | MEDIUM CLASSIFICATION | TABLE IN USE |
|---|---|---|
| WARM-UP | POWER ON AND HEATING | |
| | WARM-UP AND RETURN | S-A |
| | ROTATION AFTER RELOAD | S-C |
| DURING JOB | BEFORE PAPER FEEDING | S-A |
| | DURING PAPER FEEDING | S-B |
| | AFTER PAPER FEEDING | S-C |
| STANDBY | READY STANDBY | S-C |
| | PREHEATING | S-C |
| | LOW POWER | S-C |
| | PRINT PREPARATION | S-A |

FIG. 19

| TABLE | HEATING CENTER | HEATING ENDS | PRESSING |
|---|---|---|---|
| S-A | 51% | 51% | 30% |
| S-B | 74% | 37% | 0% |
| S-C | 45% | 45% | 30% |

IMAGE FORMING APPARATUS INCLUDING A PLURALITY OF HEATING UNITS AND METHOD OF CONTROLLING THE SAME

CROSS-REFERENCE TO RELATED APPLICATIONS

The present application claims priority to and incorporates by reference the entire contents of Japanese priority document 2007-239457 filed in Japan on Sep. 14, 2007.

BACKGROUND OF THE INVENTION

1. Field of the Invention

The present invention relates to an image forming apparatus such as a copying machine, a printer, a facsimile apparatus, and a digital multifunction product of an electrophotographic system, and more particularly, to an image forming apparatus including a plurality of heating units in a fixing device that fixes a toner image on a recording medium and a method of controlling the image forming apparatus.

2. Description of the Related Art

In recent years, there is an increasing demand for high image formation speed in image forming apparatuses. To realize the high image formation speed, the image forming apparatuses are increased in size and power consumption thereof also increases.

In particular, large electric power is necessary in an image forming apparatus that uses a fixing device of a heat roller system for pressing and heating a member to be heated such as paper or film having a toner image formed thereon.

In a high-speed image forming apparatus, a plurality of heaters as heating means are necessary to reduce warm-up time of a fixing device. When the heaters of the fixing device are turned on and off, fluctuation in a power supply voltage tends to be caused by current consumption and the like of the heaters. This may cause flicker, harmonic distortion, terminal noise, and the like in other electronic apparatuses that use the same power supply. Therefore, it is necessary to take measures for suppressing the fluctuation in a power supply voltage.

As such measures, for example, Japanese Patent Application Laid-open No. 2003-217793 discloses a method of, when electric power is supplied to a plurality of heaters in a fixing device, rather than simultaneously turning the heaters on, turning the heaters on at delayed timing while soft-starting the heaters individually.

However, in such conventional power supply control method, when a plurality of heaters in a fixing device are driven, there must be a period in which all heaters are turned on because the turn-on start timing is simply delayed, and an effect for reducing fluctuation in a power supply voltage is not enough, which may cause ripple, flicker, and the like in other electronic apparatuses that use the same power supply.

SUMMARY OF THE INVENTION

It is an object of the present invention to at least partially solve the problems in the conventional technology.

According to an aspect of the present invention, there is provided an image forming apparatus including a fixing device that fixes a toner image formed on a medium by applying pressure and heat onto the medium, which includes a plurality of heating units having different power consumptions; a power supplying unit that supplies a power to each of the heating units; and a control unit that repeatedly controls a supply of the power to the heating units by the power supplying unit at a predetermined control period T1. The control unit includes a first unit that sets the control period T1, a second unit that sets a power supply time t1 for a first heating unit having largest power consumption from among heating units to which the power is supplied within the control period T1 and a power supply time t2 for a second heating unit having second largest power consumption, and a third unit that performs control to supply the power to the first heating unit for a period of the power supply time t1 from beginning of the control period T1 and to supply the power to the second heating unit for a period from a point obtained by subtracting the power supply time t2 from end of the control period T1 to the end of the control period T1.

Furthermore, according to another aspect of the present invention, there is provided a method of controlling a supply of power to a plurality of heating units having different power consumptions in a fixing device that fixes a toner image formed on a medium by applying pressure and heat onto the medium. The method includes setting a predetermined control period T1 for repeatedly controlling the supply of the power to the heating units; setting a power supply time t1 for a first heating unit having largest power consumption from among heating units to which the power is supplied within the control period T1 and a power supply time t2 for a second heating unit having second largest power consumption; and controlling including supplying the power to the first heating unit for a period of the power supply time t1 from beginning of the control period T1, and supplying the power to the second heating unit for a period from a point obtained by subtracting the power supply time t2 from end of the control period T1 to the end of the control period T1.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 15 is a diagram of an S-A table used mainly in a warm-up mode among tables in which, for each usable power at respective levels, data of ratios of respective power supply times for heating means to which electric power is supplied within a control period T1 with respect to the control period T1 are stored;

FIG. 16 is a diagram of an S-B table mainly used during paper feeding in a copy mode among the tables;

FIG. 17 is a diagram of an S-C table mainly used in a standby mode among the tables;

FIG. 18 is a diagram of a correspondence relation between operation modes of the image forming apparatus and tables in use;

FIG. 19 is a diagram of an example of use of tables during a copy operation (during a job);

DETAILED DESCRIPTION OF THE PREFERRED EMBODIMENTS

Exemplary embodiments of the present invention are explained in detail below with reference to the accompanying drawings.

Figure 3:
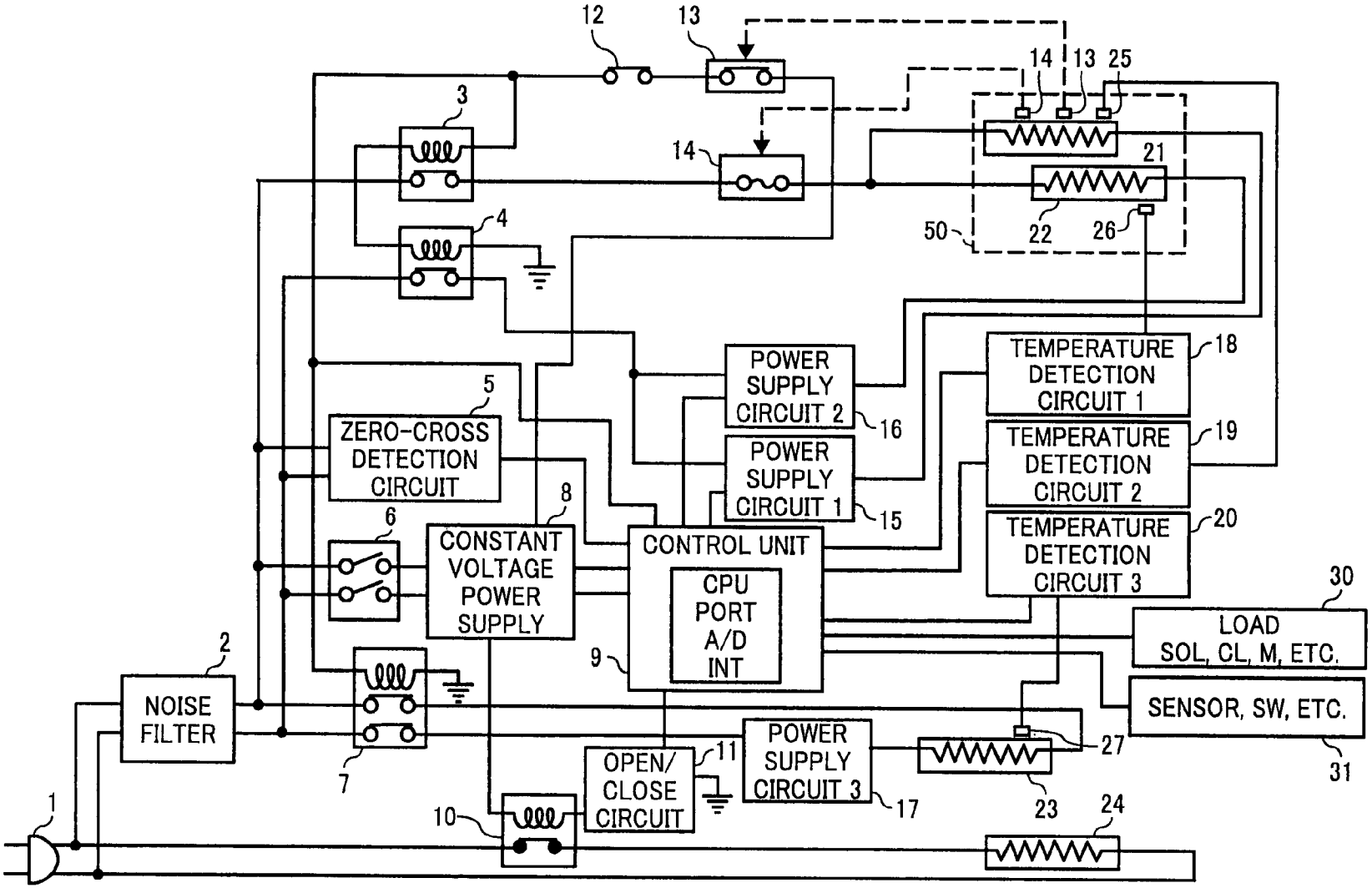
FIG. 3 is a diagram of an AC power control circuit of an image forming apparatus according to an embodiment of the present invention.

FIG. 3 is a diagram of an AC power control circuit of an image forming apparatus according to an embodiment of the present invention.

In the AC power control circuit shown in FIG. 3, a pair of power supply lines connected to an AC plug 1 put into a socket of an AC 100 volts commercial power supply are connected to normally-open contacts of a relay 7, a relay 3, and a relay 4, a main power switch 6, and the zero-cross detection circuit 5 through a noise filter 2. On the other hand, the power supply line is also connected to a normally-closed contact of a relay 10, a dehumidifying heater 24, and a series circuit.

An open/close contact of the relay 3 is connected to one terminal of a heating center heater 21 as first heating means and one terminal of a heating end heater 22 as second heating means of a fixing device via a thermostat 14.

On the other hand, an open/close contact of the relay 4 is connected to respective input terminals of power supply circuits 15 and 16 as power supplying means. The respective output terminals of the power supply circuits 15 and 16 are connected to the other terminal of the heating center heater 21 and the other terminal of the heating end heater 22.

The power supply circuits 15 and 16 include TRIACs. The TRIACs become conductive according to a power supply signal from a control unit 9 and supply electric power to the heating center heater 21 and the heating end heater 22. Details of the supply of electric power are explained in the explanation of a fixing-control-unit control circuit shown in FIG. 7.

The thermostat 14 is a thermostat of a bimetal type and is actually provided in a fixing device 50 explained later referring to FIG. 4. However, in FIG. 3, for convenience of illustration, a temperature sensing unit is shown in the fixing device 50, a contact unit is shown on the circuit, and the temperature sensing unit and the contact units are connected by a broken arrow. When the temperature of a fixing roller in the fixing device 50 reaches the melting temperature, a contact in the thermostat 14 is opened. As the thermostat 14, a thermostat of a type in which, once a contact is opened, temperature falls and an open state of the contact is maintained is adopted.

The thermostat 14 is connected in series to a power feeding circuit to the heating center heater 21 and the heating end heater 22. Therefore, when the contact is opened, the supply of electric power from the commercial power supply is interrupted.

An output of the zero-cross detection circuit 5, to which an alternating current from a commercial power supply is input through the noise filter 2, is input to an interrupt terminal of a central processing unit (CPU) provided in the control unit 9. Interrupt is caused by a zero-cross signal from the zero-cross detection circuit 5. During a processing routine for the interrupt, the CPU sets phase control turn-on times for the heaters 21, 22, and 23 and sets duty time using PID control or a table. Details of the setting are explained in the explanation of a fixing-control-unit control circuit shown in FIG. 7. Details of the zero-cross detection circuit 5 are also explained later referring to FIGS. 5 and 6.

A dual normally-open contact of the relay 7 is connected to both ends of a series circuit of a pressing heater 23 as third heating means and a power supply circuit 17 as power supplying means. The power supply circuit 17 also includes a TRIAC. The TRIAC becomes conductive according to a power supply signal from the control unit 9 and supplies electric power to the pressing heater 23.

A dual output of the main power switch 6 is connected to a constant voltage power supply 8 that generates a constant voltage. The constant voltage power supply 8 supplies the constant voltage to the control unit 9 as control means and a DC load 30 and to exciting coils of the relays 3, 4, and 7 via a thermostat 13 and a door switch 12. Therefore, when the main power switch 11 is turned on and the constant voltage power supply 8 generates the constant voltage, the exciting coils of the relays 3, 4, and 7 are excited and normally-open contacts of the relays are closed.

The exciting coils of the relays 3, 4, and 7 are supplied with an electric power from the constant voltage power supply 5 via the thermostat 13 provided in the fixing device 50 and the door switch 12 connected in series to the thermostat 13.

Therefore, when a door of the image forming apparatus is opened and the door switch 12 is opened or when a contact in the thermostat 13 is opened because of a temperature rise in the fixing device 50, the supply of electric power to the heating enter heater 21, the heating end heater 12, and the pressing heater 23 is stopped. The thermostat 13 is also actually provided in the fixing device 50 explained later referring to FIG. 4. However, in FIG. 3, for convenience of illustration, a temperature sensing unit is shown in the fixing device 50, a contact unit is shown on the circuit, and the temperature sensing unit and the contact unit are connected by a broken arrow.

A power supply line from the AC plug 1 is directly connected to a series circuit of the normally-closed contact of the relay 10 and the dehumidifying heater 24. Therefore, when the main power switch 6 is off in a state in which the AC plug 1 is put into the socket of the commercial power supply, electric power is supplied to the dehumidifying heater 24.

When the main power switch 6 is turned on, electric power is supplied to the exciting coil of the relay 10 from the constant voltage power supply 8 and the normally-closed contact of the relay 10 opens. However, by opening the open/close circuit 11, it is possible to supply electric power to the dehumidifying heater 24 even in a state in which the main power switch 6 is turned on.

A non-contact sensor 25 is provided as a sensor for surface temperature detection for a heating roller center section of the fixing device. A non-contact sensor 26 is provided as a sensor for surface temperature detection for heating roller ends. A thermistor 27 that is brought into contact with the surface of a heating roller is provided as a sensor for surface temperature detection for a pressing roller. The temperatures of the respective units are detected by the temperature detection circuits 18, 19, and 20.

Electric power is supplied to the heating center heater 21 for turn-on time within a fixed time determined by the temperature detected by the non-contact sensor 25 and an operation mode at that point.

Similarly, electric power is supplied to the heating end heater 22 for turn-on time within a fixed time determined by the temperature detected by the non-contact sensor 26 and an operation mode at that point.

Electric power is also supplied to the pressing heater 23 for turn-on time within a fixed time determined by the temperature detected by the thermistor 27 and an operation mode at that point.

Rated power in this embodiment is set to, for example, 700 watts for the heating center heater, 700 watts for the heating end heater, and 500 watts for the pressing heater. However, specific power consumption by the respective heating means in the control unit explained later is different from the rated power.

Figure 4:
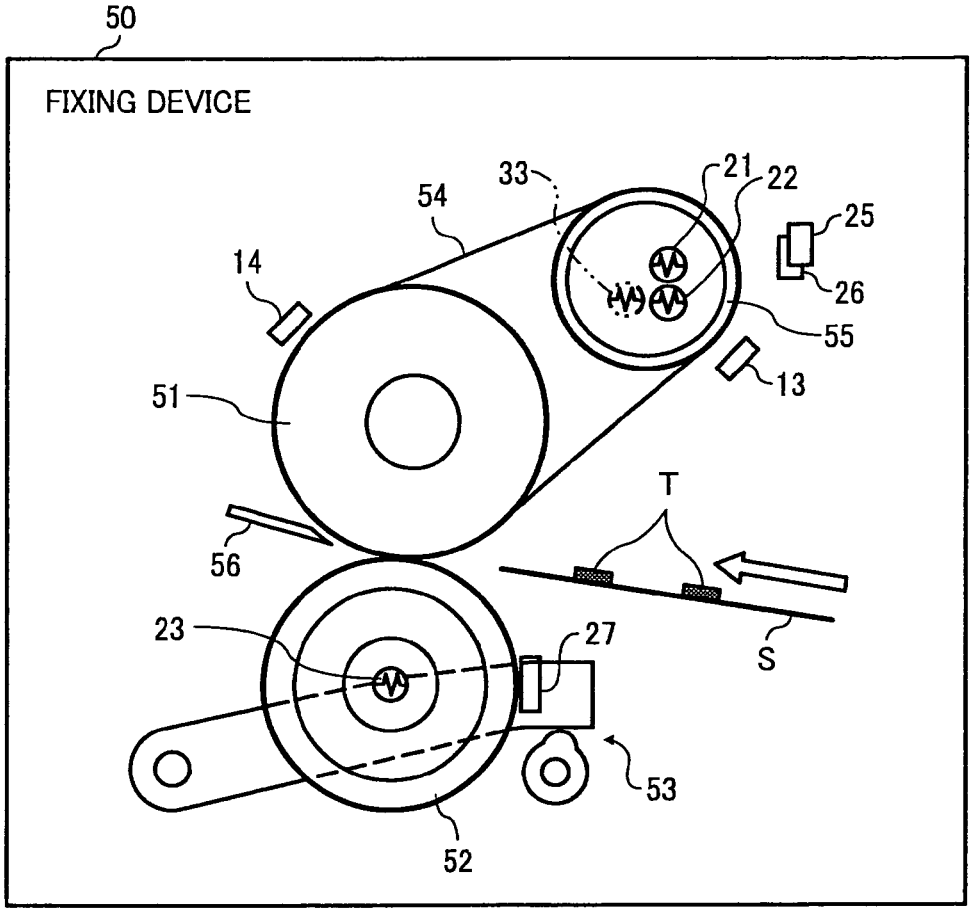
FIG. 4 is a schematic sectional view of a configuration of a fixing device in the image forming apparatus.

The fixing device 50 shown in FIG. 4 includes a fixing roller 51 as a fixing member, a pressing roller 52 as a pressing member, a pressing unit 53 that presses the pressing roller 52 against the fixing roller 51 with fixed pressing force, a fixing belt 54, and a heating roller 55 that heats the fixing belt 54. The fixing roller 51, the pressing roller 52, and the heating roller 55 are driven to rotate by a driving mechanism (not shown).

The fixing device 50 includes, as heating means, the heating center heater 21 and the heating end heater 22 arranged in the heating roller 55 and the pressing heater 23 arranged in the pressing roller 52. In a second embodiment explained later, the fixing device 50 further includes a heating auxiliary heater 33 in the heating roller 55 as indicated by an imaginary line.

Moreover, as shown in FIG. 3, the non-contact sensor 25 is provided as a sensor for surface temperature detection for the center of the heating roller 52, the non-contact sensor 26 is provided as a sensor for surface temperature detection for the ends of the heating roller 55, and the thermistor 27 that are brought into contact with the surface of the pressing roller 52 is provided as a sensor for surface temperature detection for the pressing roller 52. All of the sensors and the thermistor senses temperature at a temperature detection period of 20 milliseconds.

The thermostat 13 and the thermostat 14 shown in FIG. 3 are arranged near the heating roller 52 and the fixing roller 51. Reference numeral 56 denotes a separation plate.

Electric power is supplied to the heating center heater 21 for turn-on time within a fixed time (a control period) determined by the temperature detected by the non-contact sensor 25 and an operation mode at that point.

Similarly, electric power is supplied to the heating end heater 22 for turn-on time within a fixed time determined by the temperature detected by the non-contact sensor 26 and an operation mode at that point.

Electric power is also supplied to the pressing heater 23 for turn-on within a fixed time determined by the temperature detected by the thermistor 27 and an operation mode at that point.

At warm-up time of the fixing device 50, because power consumption in the other units is small, it is possible to simultaneously supply electric power to the heating center heater 21 and the heating end heater 22. In the second embodiment, it is also possible to simultaneously supply electric power to the heating auxiliary heater 33.

In the fixing device 50, when a sheet S carrying a toner image T passes a nip section between the fixing roller 51 and the pressing roller 52 in an arrow direction, the sheet S is heated and pressed by the fixing roller 51 and the pressing roller 52. Consequently, the toner image T is fixed on the sheet S.

The sheet S on which the toner image T is fixed is separated from the surface of the fixing roller 51 by a separation plate 56 and conveyed in a sheet discharge direction.

Figure 5:
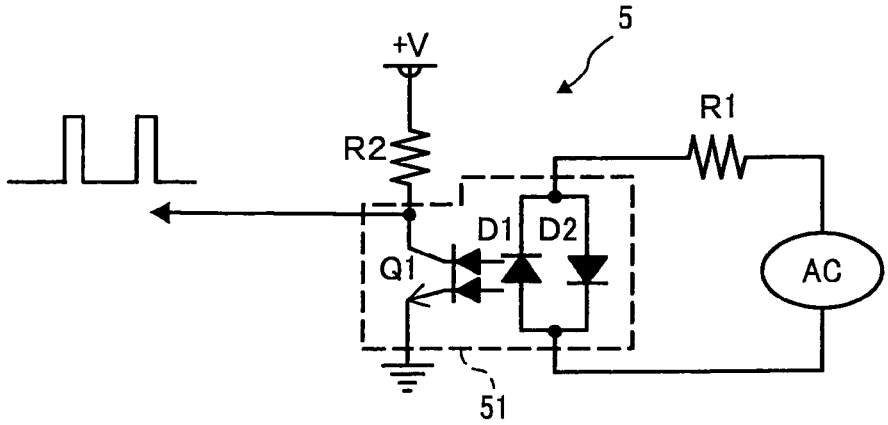
FIG. 5 is a circuit diagram of a specific example of a zero-cross detection circuit 5 shown in FIG. 1.

FIG. 5 is a circuit diagram of an example of a configuration of the zero-cross detection circuit 5 shown in FIG. 3. The zero-cross detection circuit 5 includes a photo-coupler 51 including light-emitting diodes D1 and D2 connected inverse-parallel to a photo-transistor Q1, a resistor R1 connected in series to a circuit that supplies an alternating current AC to the light-emitting diodes D1 and D2, and a resistor R2 connected between a collector of the photo-transistor Q1, to which an emitter is grounded, and a DC power supply +V. The zero-cross detection circuit 5 outputs a pulse-like zero-cross signal from the collector of the photo-transistor Q1.

In the zero-cross detection circuit 5, when an AC voltage rises, an electric current flows to one of the light-emitting diodes D1 and D2, the light-emitting diode emits light, and the photo-transistor Q1 is turned on. When the AC voltage falls to near a zero-cross point, the electric current flowing to the light-emitting diode D1 or D2 decreases to be very small, the light-emitting diode stops light emission, and the photo-transistor Q1 is turned off. When the photo-transistor Q1 is on, a collector voltage thereof is a ground potential. When the photo-transistor Q1 is turned off, the collector voltage is a potential of the DC power supply +V. Therefore, the zero-cross detection circuit 5 outputs a pulse-like zero-cross signal shown in the figure from the collector of the photo-transistor Q1.

Figure 6:
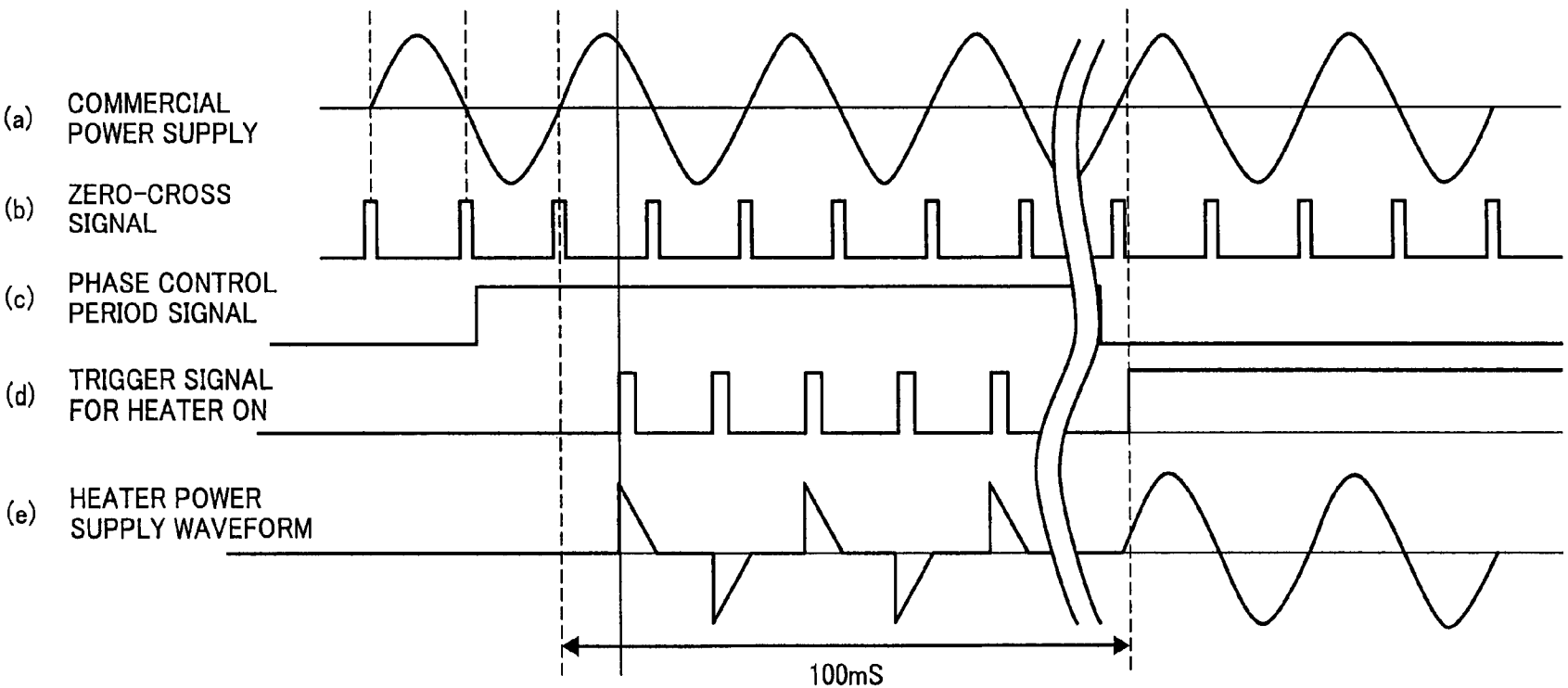
FIG. 6 is a timing chart for supplying electric power to a heater based on a zero-cross signal.

A relation between an AC voltage waveform of the commercial power supply and generation timing of a zero-cross signal is shown in (a) and (b) of FIG. 6. As shown in the figure, in each of half-periods of the AC voltage waveform, the zero-cross signal is generated as a narrow pulse signal with a zero-cross point (an instance when a voltage changes to ±0 volt when plus and minus of the AC voltage are inverted) as the center.

Figure 7:
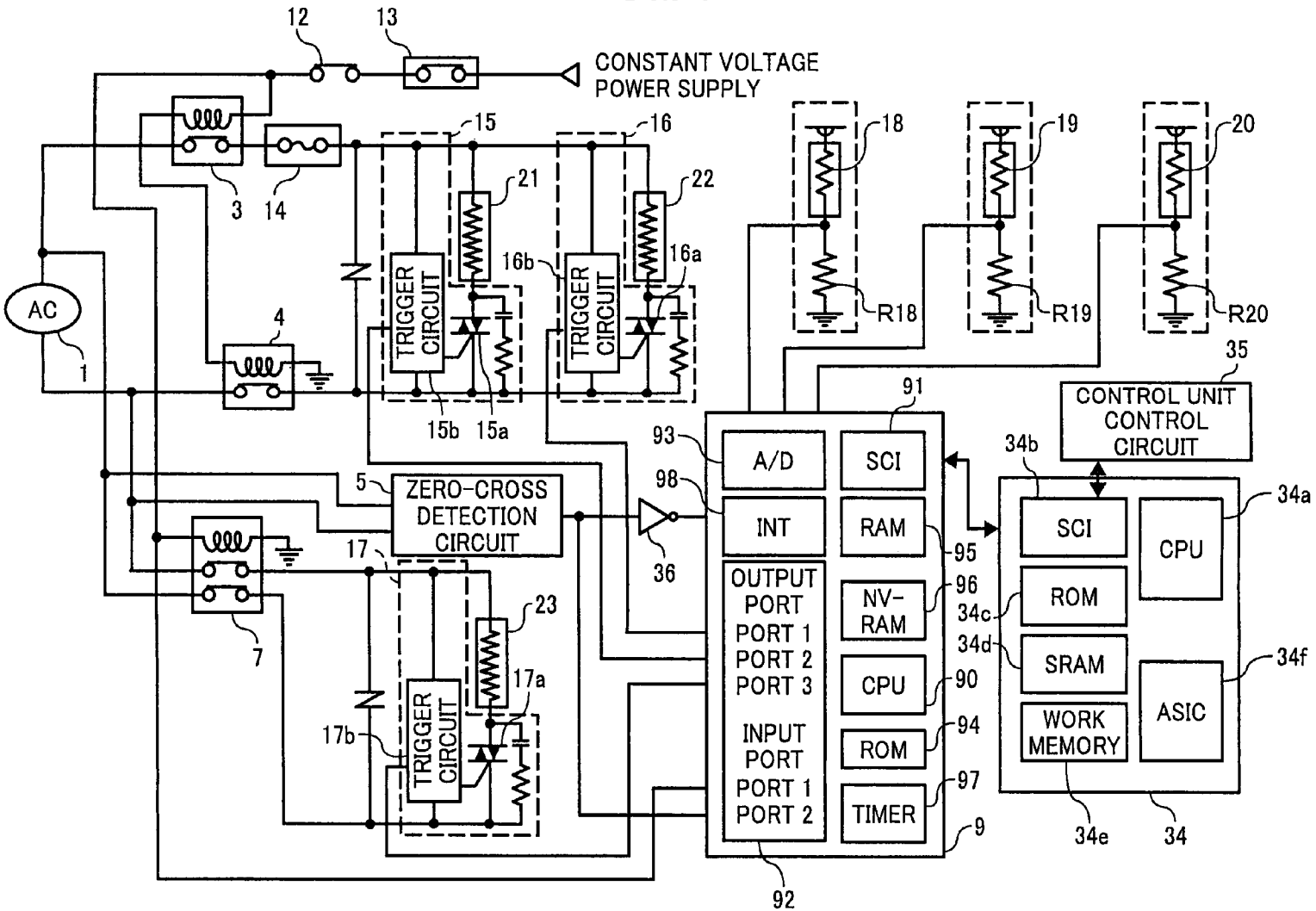
FIG. 7 is a detailed circuit diagram of a section related to control of the fixing device in the AC power control circuit shown in FIG. 1.

In FIG. 7, functional units same as those in FIG. 3 are denoted by the same reference numerals and signs and explanation of the functional units is omitted. The AC plug 1 shown in FIG. 3 is shown as an AC power supply AC in FIG. 7.

As shown in FIG. 7, the control unit 9 includes the CPU 90 and a serial controller (SCI) 91, an input/output port 92, an analog/digital (A/D) converter 93, a read only memory (ROM) 94, a random access memory (RAM) 95, an nonvolatile-random access memory (NV-RAM) 96, a timer 97, and an interrupt control circuit (INT) 98 connected to the CPU 90 by a bus.

Temperature detection signal lines of the temperature detection circuit 19 for the heating roller center, the temperature detection circuit 18 for the heating roller ends, and the temperature detection circuit 20 for the pressing roller are connected to an input port of the A/D converter 93.

The temperature detection circuit 19 includes the non-contact sensor 25 and a resistor R19 connected thereto in series. The temperature detection circuit 19 detects the temperature in a measurement area corresponding to surface temperature detection for the center of the heating roller 55 (FIG. 4).

The temperature detection circuit 18 includes the non-contact sensor 26 and a resistor R18 connected in series thereto. The temperature detection circuit 18 detects the temperature of a measurement area corresponding to surface temperature detection for the ends of the heating roller 55 (FIG. 4).

The temperature detection circuit 20 includes the thermistor 27 that brought into contact with the surface of the pressing roller and a resistor R20 connected in series thereto. The temperature detection circuit 20 detects the temperature of a measurement area corresponding to the surface temperature detection for the pressing roller 52 (FIG. 4).

The zero-cross signal from the zero-cross detection circuit 5 explained referring to FIG. 5 is input to an input port 2 of the input/output port 92 and is inverted by an inverting circuit 36 and input to the interrupt control circuit (INT) 98 as well. An interrupt to the CPU 90 occurs at a rising edge of the zero-cross signal input to the interrupt control circuit (INT) 98.

The power supply circuit 15 includes a TRIAC 15*a* and a trigger circuit 15*b* and receives supply of electric power from the AC power supply AC. The heating center heater 21 is connected in series to the relay 3 and the thermostat 14 and connected in series to the normally-open contact of the relay 4 via the TRIAC 15*a*. A gate of the TRIAC 15*a* is connected to the trigger circuit 15*b*. The trigger circuit 15*b* is connected to the port 2 of the input/output port 92 of the control unit 9.

The power supply circuit 16 includes a TRIAC 16*a* and a trigger circuit 16*b* and receives supply of electric power from the AC power supply AC. The heating end heater 22 is connected in series to the relay 3 and the thermostat 14 and connected in series to the normally-open contact of the relay 4 via the TRIAC 16*a*. A gate of the TRIAC 16*a* is connected to the trigger circuit 16*b*. The trigger circuit 16*b* is connected to a port 1 of the input/output port 92 of the control unit 9.

The power supply circuit 17 includes a TRIAC 17*a* and a trigger circuit 17*b* and receives supply of electric power from the AC power supply AC via the relay 7. The pressing heater 23 is connected in series to one normally-open contact of the relay 7 and connected in series to the other normally-open contact of the relay 4 via the TRIAC 17*a*. A gate of the TRIAC 17*a* is connected to the trigger circuit 17*b*. The trigger circuit 17*b* is connected to a port 3 of the input/output port 92 of the control unit 9.

Buffer circuits 37, 38, and 39 including series circuit of capacitors and resistors are connected in parallel to the TRIACs 15*a*, 16*a*, and 17*a* of the power supply circuit 15, 16, and 17, respectively. The buffer circuits 37, 38, and 39 suppress a sudden change in an electric current when the TRIACs are turned on and off.

Because circuit operations of the power supply circuits 15, 16, and 17 are the same, only the power supply circuit 15 is explained.

The control unit 9 shown in FIG. 7 has a function of generating a trigger signal. When a trigger signal for turning on a heater shown in (d) of FIG. 6 is output from the port 2 of the input/output port 92, according to the trigger signal, the trigger circuit 15*b* applies a trigger pulse to the gate of the TRIAC 15*a* and makes the TRIAC 15*a* conductive. Consequently, electric power of a heater power supply waveform shown in (e) of FIG. 6 is supplied to the heating center heater 21.

Therefore, the power supplying circuits 15, 16, and 17 have means for controlling a conduction angle for each of half-waves of an alternating current supplied to the heaters 21, 22, and 23. In supplying electric power to the heaters 21, 22, and 23, the power supplying circuits 15, 16, and 17 can sequentially change the conduction angle from a minimum value to a maximum value in a predetermined period from a start point of the supply of the alternating current and soft-start the heaters.

Figure 8:
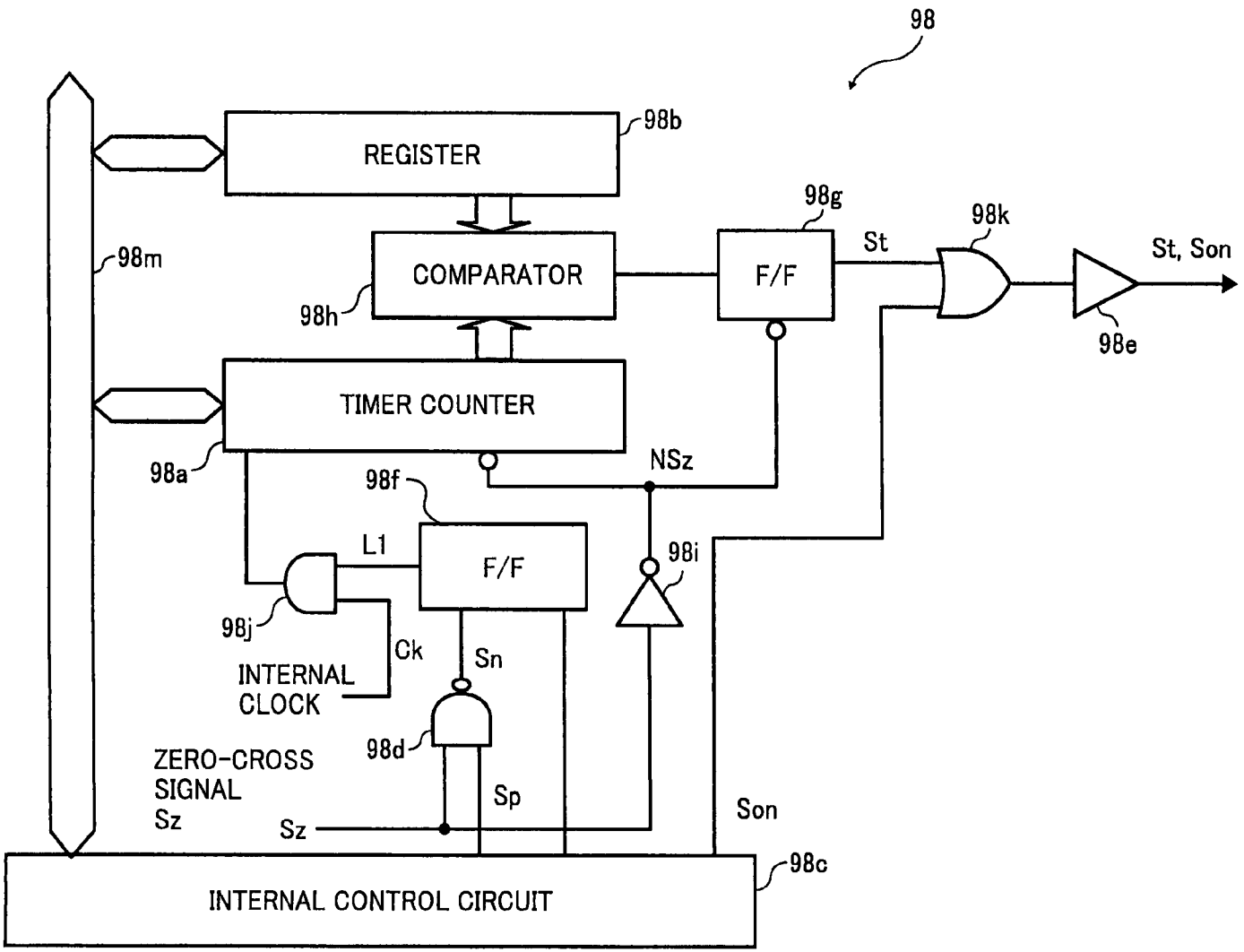
FIG. 8 is a block diagram of a function for generating a trigger signal in a control unit 9 shown in FIG. 1.

FIG. 8 is a diagram of a function for generating a trigger signal with an internal timer function of the CPU 90 in the control unit 9 shown in FIG. 7. In FIG. 8, the function is shown as a block circuit (a trigger signal generating circuit).

In a trigger signal generating circuit 98 shown in the figure, a timer counter 98*a* counts an internal clock. A register 98*b* is a register written by software. Time for turning on the TRIAC 15*a* with the zero-cross signal as a reference, i.e., time for starting phase control is written in the register 98*b*.

As the time for starting the phase control, time set in advance by an operation mode or the like is written in a software manner in an interrupt control routine of the zero-cross signal.

An internal control circuit 98*c* is connected to an internal bus 98*m* of the CPU 90 and writes a specific code determined in advance in a register in the inside thereof. Consequently, a signal Sp in a phase control period 100 microseconds is output and, after 100 microseconds, a heater ON signal Son is output.

The heater ON signal Son (duty for turning on the heater 21) is determined by PID control or the like based on a temperature detection result immediately before a fixed time T.

The phase control period 100 microseconds and the time of the heater ON signal are generated in a timer routine performed by using an internal timer.

Figure 9:
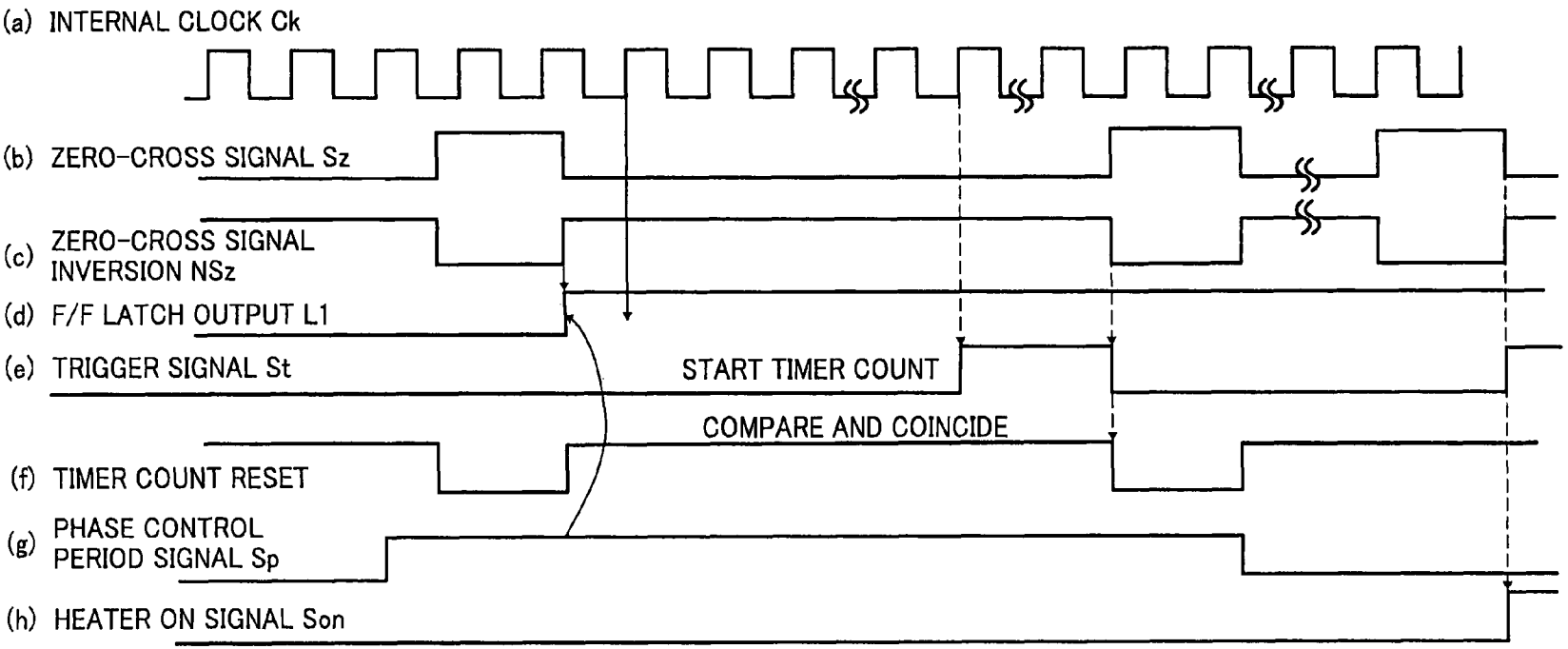
FIG. 9 is a timing chart for explaining operations of the circuit shown in FIG. 8.

The phase control period signal Sp shown in (g) of FIG. 9 is output from the internal control circuit 98*c* and input to one input terminal of a NAND circuit 98*d* and a zero-cross signal Sz shown in (b) of FIG. 9 is input to the other input terminal of the NAND circuit 98*d*. Then, a latch circuit (FF) 98*f* is latched at a rising edge of an output signal Sn of the NAND circuit 98*d* and sets a latch output L1 to high as shown in (d) of FIG. 9. An output of an AND circuit 98*j* that inputs the latch output L1 and an internal clock Ck shown in (a) of FIG. 9 is input to a timer counter 8*a*. A rising edge of the internal clock Ck in a period in which the latch output L1 is high is counted.

When a predetermined time (e.g., 100 milliseconds) written in the register 98*b*, in which time for starting the phase control in a software manner, is counted by the timer counter 98*a*, a coincidence signal is output from a comparator 98*h* and latched to a latch circuit (FF) 98*g*. A latch output of the latch circuit (FF) 98*g* is a trigger signal St shown in (e) of FIG. 9.

The trigger signal St is maintained until a zero-cross inverse signal NSz shown in (c) of FIG. 9, which is obtained by inverting the zero-cross signal with an inverter 98*i*, is input to a reset terminal of the latch circuit 98*g*. The trigger signal St is output through an OR circuit 98*k* and a buffer amplifier 98*e*.

The timer counter 98*a* is cleared by the zero-cross inverse signal NSz. The timer counter 98*a* starts a new count when the zero-cross inverse signal NSz changes to high. Timing for resetting the timer counter is shown in (f) of FIG. 9. Time for starting new phase control is written in the interrupt control routine by the zero-cross signal.

When the phase control for the predetermined time (100 milliseconds) is finished, in an interrupt control routine of the next zero-cross signal, turn-on determined by PID control or the like based on respective temperature detection results is written in the internal counter. Consequently, the heater ON signal Son is output to the OR circuit 98*k* from the internal control circuit 98*c* and output through the OR circuit 98*k* and the buffer amplifier 98*e*. Therefore, the trigger signal St is output from the buffer amplifier 98*e* during the phase control period. When the turn-on is written in the internal control circuit 98*c*, the heater ON signal Son is output.

The trigger signal St and the heater ON signal Son are output from the port 2 of the input/output port 92 of the control unit 9 shown in FIG. 7 to the trigger circuit 15*b* as a trigger signal for heater ON. The trigger circuit 15*b* makes the TRIAC 15*a* conductive and supplies electric power of the heater power supply waveform shown in (e) of FIG. 6 to the heating center heater 21 and turns on the heating center hater 21.

Therefore, electric power is supplied only in a part of a period (a period of a conduction angle) for each of half-waves of an AC voltage waveform according to output timing of the trigger signal St during the phase control period and the supply of electric power is limited. However, in a period in which the heater ON signal Son is output, electric power in the entire period of the AC voltage waveform is supplied to the heater as shown on the right side in FIG. 6.

A control circuit 34 that controls the entire image forming apparatus shown in FIG. 7 includes a CPU 34*a* that controls the entire image forming apparatus and a serial controller (SCI) 34*b*, a ROM 34*c*, an SRAM 34*d*, a work memory 34*e* for image expansion used in a printer, an ASIC 34*f* mounted with a function for controlling a frame memory that temporarily stores image data of written image and peripheries of the CPU, and a not-shown interface circuit connected to the CPU 34*a* by an internal bus.

An operation unit control circuit 35 is connected to the CPU 34*a* via a serial controller. The operation unit control circuit 35 includes an input unit with which a user performs input for system setting by operating a panel and a display unit for displaying setting contents and a state of the system to the user and controls the input.

A function of the control circuit 34 is the same as that of the control circuit of the image forming apparatus in the past and is not directly related to the present invention. Therefore, detailed explanation of the function is omitted.

A specific example of control of supply of electric power to three heating means by the control unit 9 shown in FIG. 7 is explained below.

FIGS. 10 to 13 are timing charts of first to fourth power supply patterns in supplying power to first, second, and third heating means having different power consumptions within a control period T1 set by the control unit 9 shown in FIG. 7.

In these figures, the first heating means is the heating center heater 21 shown in FIGS. 3, 4, and 7 that has the largest power consumption. The second heating means is the heating end heater 22 that has the second largest power consumption. The third heating means is the pressing heater 23 that has the third largest power consumption (in this example, smallest power consumption). In this example, the first heating means consumes 637 watts, the second heating means consumes 539 watts, and the third heating means consumes 270 watts.

However, the order of the heating means is not fixedly determined. A plurality of heating means, to all of which electric power is supplied, are simply given numbers in such a manner as first, second, and third in order from one with the largest power consumption within a control period set by the CPU 90 of the control unit 9. Therefore, even if heating means is physically provided, the heating means is not included in these heating means unless the heating means is used in the control period. When there is a plurality of heating means with the same level of power consumption, whichever one may be given a smaller number.

FIGS. 15 to 17 are tables in which, for each usable power at respective levels (in FIG. 17, there is no level classification), data of ratios (duties: %) of respective times of power supply (turn-ons) to heating means (the heating center heater 21, the heating end heater 22, and the pressing heater 23) for supplying electric power within a control period T1 with respect to the control period T1 are stored. The tables are stored in the ROM 94 shown in FIG. 7. In FIGS. 15 to 17, the ratios are represented as "turn-on Duty".

FIG. 15 is an S-A table mainly used in a warm-up mode. FIG. 16 is an S-B table mainly used during paper feeding in a copy mode. FIG. 17 is an S-C table mainly used in a standby mode. Power values described in respective levels of the S-A table and the S-B table are lower limit values. For example, at a level 6 of the S-A table shown in FIG. 15, the power value is between 700 watts and 724 watts. The data of these tables are changed depending on specifications, destinations, and the like of the image forming apparatus.

FIG. 18 is a diagram of a correspondence relation between operation modes of the image forming apparatus and tables in use. Information concerning the correspondence relation is also stored in the ROM 94 shown in FIG. 7.

FIG. 19 is a diagram of an example of use of tables during a copy operation (during a job). In this example, the level 6 of the S-A table (data in a bold frame in FIG. 15) is selected and used before paper feeding. A level 6 of the S-B table (data in a bold frame in FIG. 16) is selected and used during paper feeding. The S-C table (data in a bold frame in FIG. 17) is selected and used after paper feeding. Turning-on of the respective heating means (heaters) are set and turn-on start points (turn-on start timing) are determined based on these data.

First, the CPU 90 of the control unit 9 shown in FIG. 7 sets the control period T1. In this example, the CPU 90 sets the control period T1 to 1 second (1000 milliseconds). It is advisable to set the control period T1 with the zero-cross signal (FIG. 6) generated by the zero-cross detection circuit 5 (FIGS. 3 and 5, etc.) as a reference. It is advisable to set the control period T1 to appropriate time according to an operation mode, an operation condition, and the like of the image forming apparatus.

Any one of the S-A table, the S-B table, and the S-C table is selected according to a present operation mode of the image forming apparatus. When the S-A table or the S-B table is selected, electric energy that can be used for fixing is different depending on a detailed operation in an operation mode, for example, a stapling operation or a duplex copy operation. Therefore, a level of maximum electric energy that can be used at that point is selected.

Turn-ons (power supply times) of the first heating means, the second heating means, and the third heating means that supply electric power within the control period (fixed time) T1 are calculated and set, based on the data of the duties (%) defined for the heating means, within a range of usable electric power of a maximum level at that point in a selected table. Turn-on start points (turn-on start timings) are determined.

In FIGS. 10 to 13, turn-on for the first heating means is represented as t1 and an turn-on start point therefor is represented as ta, turn-on for the second heating means is represented as t2 and an turn-on start point therefor is represented as tb, and turn-on for the third heating means is represented as t3 and turn-on start point therefor is represented as tc.

For example, when the image forming apparatus is on standby and the S-C table shown in FIG. 17 is selected, the following data is referred to:

usable power: 625 watts the first heating means (heating center): duty 45% the second heating means (heating ends): duty 45% the third heating means (pressing): duty 30%

Because a sum of products of power consumptions and duties of the heating means is maximum usable power, in this example, the maximum usable power is calculated by the following calculation:

$$673\ W\times0.45+539\ W\times0.45+270\ W\times0.30=303\ W+243\ W+81\ W=627\ W$$

Turn-ons of the heating means are calculated by the following calculation:

$$t1=1000\ mS\times0.45=450\ mS$$

$$t2=1000\ mS\times0.45=450\ mS$$

$$t3=1000\ mS\times0.30=300\ mS$$

where mS means millisecond.

The first heating means having the largest power consumption is always turned on from a first point of the control period T1. Therefore, the turn-on start point is ta=0 mS.

The second heating means having the second largest power consumption is always started to be turned on from a point obtained by subtracting turn-on t2 from the end of the control period T1. Therefore, the turn-on start point tb is calculated as follows:

$$tb=T1-t2=1000\ mS-450\ mS=550\ mS$$

Therefore, electric power is supplied to the first heating means during a period from the first point ta (0 mS) to t1 (450 mS) of the control period T1. Electric power is supplied to the second heating means in a period from the point tb, when 550 microseconds have passed from the beginning of the control period T1, to t2 (450 mS).

On the other hand, the turn-on start point tc for the third heating means having the smallest power consumption is determined such that the turn-on t3 does not overlap time for supplying electric power to both the first heating means and the second heating means in parallel within the control period T1 and, when the overlap cannot be completely prevented, the overlapping time is minimized. Therefore, in this example, any one of the following four kinds of power supply patterns (a) to (d) is selected based on a relation between the control period T1 and the turn-ons t1, t2, and t3 for the first heating means, the second heating means, and the third heating means and the turn-on start point tc for the third heating means is determined.

Figure 10:
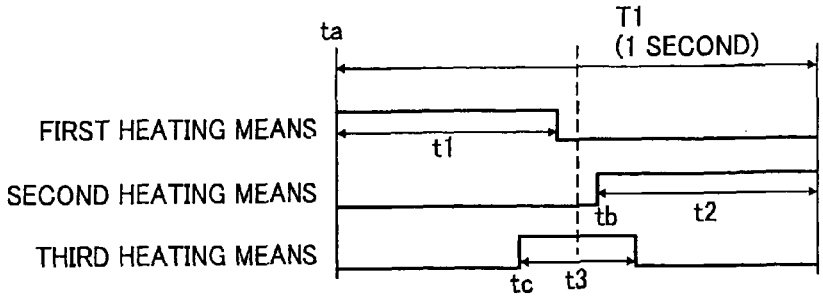
FIG. 10 is a timing chart of a first power supply pattern in supplying electric power to three heating units having different power consumptions within a control period set by the control unit 9 shown in FIG. 7.

Case (a): $t1+t2\leqq T1$ (FIG. 10)

A point obtained by subtracting T1/2+t3/2 from the end of the control period T1 is set as the turn-on start point tc for the third heating means.

When a sum of the turn-on t1 for the first heating means and the turn-on t2 for the second heating means does not exceed the control period T1, a point obtained by subtracting a half of the control period T1 (T1/2) and a half of the turn-on t3 (t3/2) from the control period is set as the turn-on start point tc for the third heating means.

$$tc=T1-(T1/2+t3/2)$$

A timing chart of a power supply pattern in this case is shown in FIG. 10.

In the example explained above, t1+t2=450 mS+450 mS=900 mS, which does not exceed the control period T1=1000 mS. Therefore, the example corresponds to this case and the turn-on start point tc is tc=1000−(1000/2+300/2)=450 mS. Therefore, electric power is supplied to the third heating means for a period of t3 (300 mS) from the point tc when 450 mS have elapsed from the point in the beginning of the control period T1.

When the levels 0 to 5 of the S-A table, the levels 0 to 5 of the S-B table, and the S-C table are selected, the levels correspond to this power supply pattern.

Case (b): $t1+t2>T1$ and $T1-t1\geqq t3$ (FIG. 11)

A point obtained by subtracting t3 from the end of the control period T1 is set as the turn-on start point tc for the third heating means.

When a sum of the turn-on t1 for the heating means and the turn-on t2 for the second heating means is longer than the control period T1 and a difference between the control period T1 and the turn-on t1 for the first heating means is longer than the turn-on t3 for the third heating means, a point obtained by subtracting the turn-on t3 from the control period T1 is set as the turn-on start point tc for the third heating means. tc=T1−t3

Figure 11:
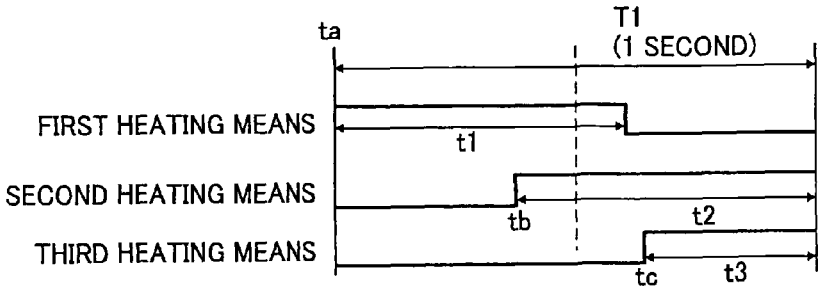
FIG. 11 is a timing chart of a second power supply pattern in supplying electric power.

A timing chart of a power supply pattern in this case is shown in FIG. 11.

When the levels 6 to 15 of the S-A table are selected, the levels correspond to this power supply pattern. For example, when the level 13 of the S-A table is selected, the following data is referred to:

usable power: 875 watts the first heating means: duty 65% the second heating means: duty 65% the third heating means: duty 30%

Therefore, turn-ons of the heating means are set as follows:

$$t1=650\ mS,\ t2=650\ mS,\ t3=300\ mS$$

Therefore, t1+t2=650 mS+650 mS=1300 mS>T1 and T1−t1=1000 mS−650 mS=350 mS≧t3=300 mS. The turn-ons correspond to this case.

The turn-on start points (timings for supplying electric power) ta, tb, and tc for the first, second, and third heating means are determined as follows:

$$ta=0\ mS$$

$$tb=T1-t2=1000\ mS-650\ mS=350\ mS$$

$$tc=T1-t3=1000\ mS-300\ mS=700\ mS$$

Therefore, electric power is supplied to the first heating means for a period of 650 milliseconds from the beginning of the control period T. Electric power is supplied to the second heating means for a period of 650 milliseconds from a point when 350 milliseconds have elapsed from the beginning of the control period T1. Electric power is supplied to the third heating means for a period of 300 milliseconds from a point when 700 milliseconds have elapsed from the beginning of the control period T1.

Figure 12:
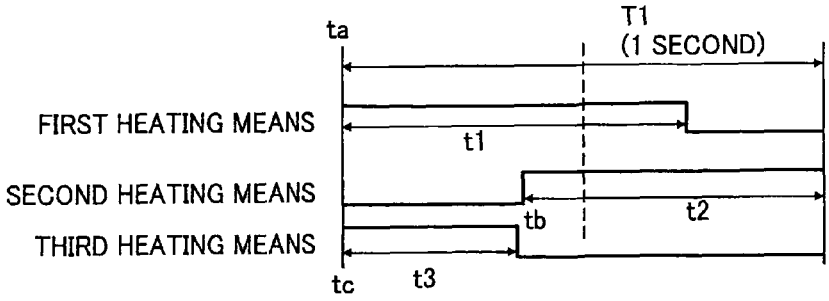
FIG. 12 is a timing chart of a third power supply pattern in supplying electric power.

Case (c): t1+t2>T1 and T1−t2≧t3 (FIG. 12)

A point in the beginning of the control period T1 is set as the turn-on start point tc for the third heating means.

When a sum of the turn-on t1 for the first heating means and the turn-on t2 for the second heating means exceeds the control period T1 and a difference between the control period T1 and the turn-on t2 for the second heating means is longer than the turn-on t3 for the third heating means, turning on the third heating means is started from the beginning of the control period T1. tc=0 mS A timing chart of a power supply pattern in this case is shown in FIG. 12.

When the levels 18 to 21 of the S-B table or the levels 6 to 15 of the S-A table are selected, the levels correspond to this power supply pattern. The levels 6 to 15 of the S-A table also correspond to the case (b) explained above. However, the turn-on start point tc for the third heating means can be determined according to any of the power supply patterns.

In FIG. 12, an example in the following case is shown as an example of a typical case (not included in the tables):

the first heating means: duty 75% the second heating means: duty 65% the third heating means: duty 30%

In this case, t1=750 mS, t2=650 mS, and t3=300 mS. Therefore, t1+t2=750 mS+650 mS=1400 mS>T1 and T1−t2=1000 mS−650 mS=350 mS≧t3=300 mS. Therefore, the turn-ons correspond to this case.

The turn-on start points (timings for supplying electric power) ta, tb, and tc for the first, second, and third heating means are determined as follows:

$$ta=0\ \text{mS}$$

$$tb=T1-t2=1000\ \text{mS}-650\ \text{mS}=350\ \text{mS}$$

$$tc=0\ \text{mS}$$

Therefore, electric power is supplied to the first heating means for a period of 750 milliseconds from the beginning of the control period T1. Electric power is supplied to the second heating means for a period of 650 milliseconds from a point when 350 milliseconds have elapsed from the beginning of the control period T1. Electric power is supplied to the third heating means for a period of 300 milliseconds from the beginning of the control period T1.

However, it is not preferable to simultaneously start turning on two heating means because power consumption suddenly increases and voltage fluctuation tend to occur. Therefore, it is desirable to set the turn-on start point tc for the third heating means at a point slightly delayed from the point in the beginning of the control period T1, which is the turn-on start point ta for the first heating means, and stagger turn-on start points (timings) for the first heating means and the third heating means.

Figure 13:
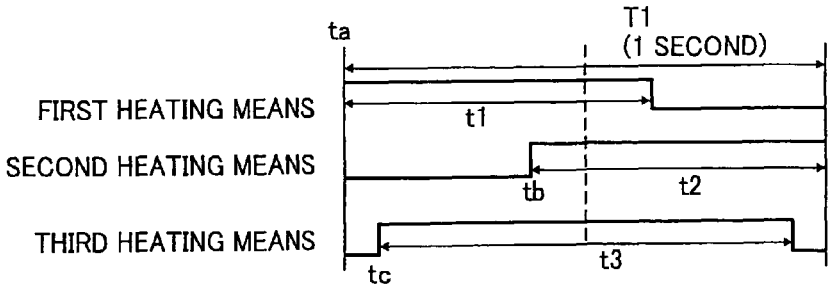
FIG. 13 is a timing chart of a fourth power supply pattern in supplying electric power.

Case (d): Not Belonging to Any of (a) to (c) (FIG. 13)

When t1+t2>T1 and T1−t1<t3 and T1−t2<t3, a point obtained by subtracting T1/2+t3/2 from the end of the control period T1 is set as the point tc. tc=T1−(T1/2+t3/2)

This is the same as the case (a) explained above.

When the levels 16 to 23 or the levels 22 to 23 of the S-B table are selected, the levels correspond to this power supply pattern.

In FIG. 13, an example of the following case is shown as an example of a typical case (not included in the tables)

the first heating means: duty 70% the second heating means: duty 65% the third heating means: duty 80%

In this case, t1=700 mS, t2=650 mS, and t3=800 mS. Therefore, t1+t2=700 mS+650 mS=1350 mS>T1, T1−t1=1000 mS−700 mS=300 mS<t3=800 mS, and T1−t2=1000 mS−650 mS=350 mS<t3=800 mS. Therefore, the turn-ons correspond to this case.

The turn-on start points (timings for supplying electric power) ta, tb, and tc for the first, second, and third heating means are determined as follows:

$$ta=0\ \text{mS}$$

$$tb=T1-t2=1000\ \text{mS}-650\ \text{mS}=350\ \text{mS}$$

$$tc=T1-(T1/2+t3/2)=1000-(1000/2+800/2)=100\ \text{mS}$$

Therefore, electric power is supplied to the first heating means for a period of 700 milliseconds from the beginning of the control period T1. Electric power is supplied to the second heating means for a period of 650 milliseconds from a point when 350 milliseconds have elapsed from the beginning of the control period T1. Electric power is supplied to the third heating means for a period of 800 milliseconds from a point when 100 milliseconds have elapsed from the beginning of the control period T1.

In the case of the levels 0 to 17 in the S-B table shown in FIG. 16, because the third heating means (the pressing heater 23) has the turn-on duty of 0% and does not become conductive, electric power is supplied to only the first heating means and the second heating means. Therefore, it is unnecessary to determine an turn-on start point for the third heating means.

In this case, as in the above case, the first heating means is always turned on from the point in the beginning of the control period T1 and the second heating means is always turned on from the point obtained by subtracting the turn-on t2 from the end of the control period T1.

Even when the power supply control according to the present invention is applied to the heating means of the fixing device of the image forming apparatus in this way, when turning on the heating means is started, it is desirable to soft-start the heating means as in the past to reduce a rush current.

Figure 14:
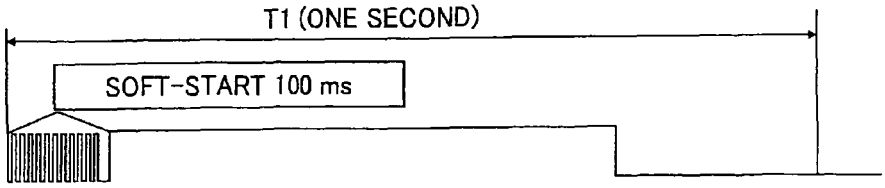
FIG. 14 is a diagram for explaining soft start in starting supply of electric power to heating means.

FIG. 14 is a diagram for explaining the soft-start and is an example of the start of turning on the first heating means from the point in the beginning of the control period T1.

In this example, a period of 100 milliseconds after the start of turning on is set as a soft-start period. Phase control is performed for each of half-waves of an alternating current for supplying conduction angles of the TRIACs 15*a*, 16*a*, and 17*a* of the power supply circuits 15, 16, and 17 to the heating means (the heaters 21, 22, and 23) to soft-start the heating means. A period of 100 milliseconds in the timing chart shown in FIG. 6 corresponds to this soft-start period. In this soft-start period, conduction angles of the TRIACs for each of the half-waves of the alternating current can be fixed (equal to or smaller than 90 degrees) as shown in (e) of FIG. 6. However, if conduction is sequentially changed from a minimum value to a maximum value, smoother soft-start can be performed.

In the example shown in FIG. 14, assuming that a conduction period of the first heating means within the control period T1 is 750 milliseconds, soft-start is performed for a period of 100 milliseconds after the start of turning on. From a point when the soft-start is finished, electric power can be continuously supplied to the first heating means for a remaining period of 650 milliseconds. In the period, phase control and PID are performed based on a result of temperature detection for the heating means by the temperature detection circuit 19 and target temperature. However, because the phase control and the PID are not peculiar to the present invention, detailed explanation thereof is omitted.

The power supply control by the present invention explained above is repeatedly performed in the set control period T1, a table is selected every time the power supply control is performed, and turn-ons for the heating means are set referring to the data of the turn-on Duty of the heating means within a range of maximum usable power at that point. When electric power is also supplied to the third heating means, the turn-on start point tc for the third heating means is determined and the supply of electric power to the heating means in one control period after that is controlled.

Figure 20:
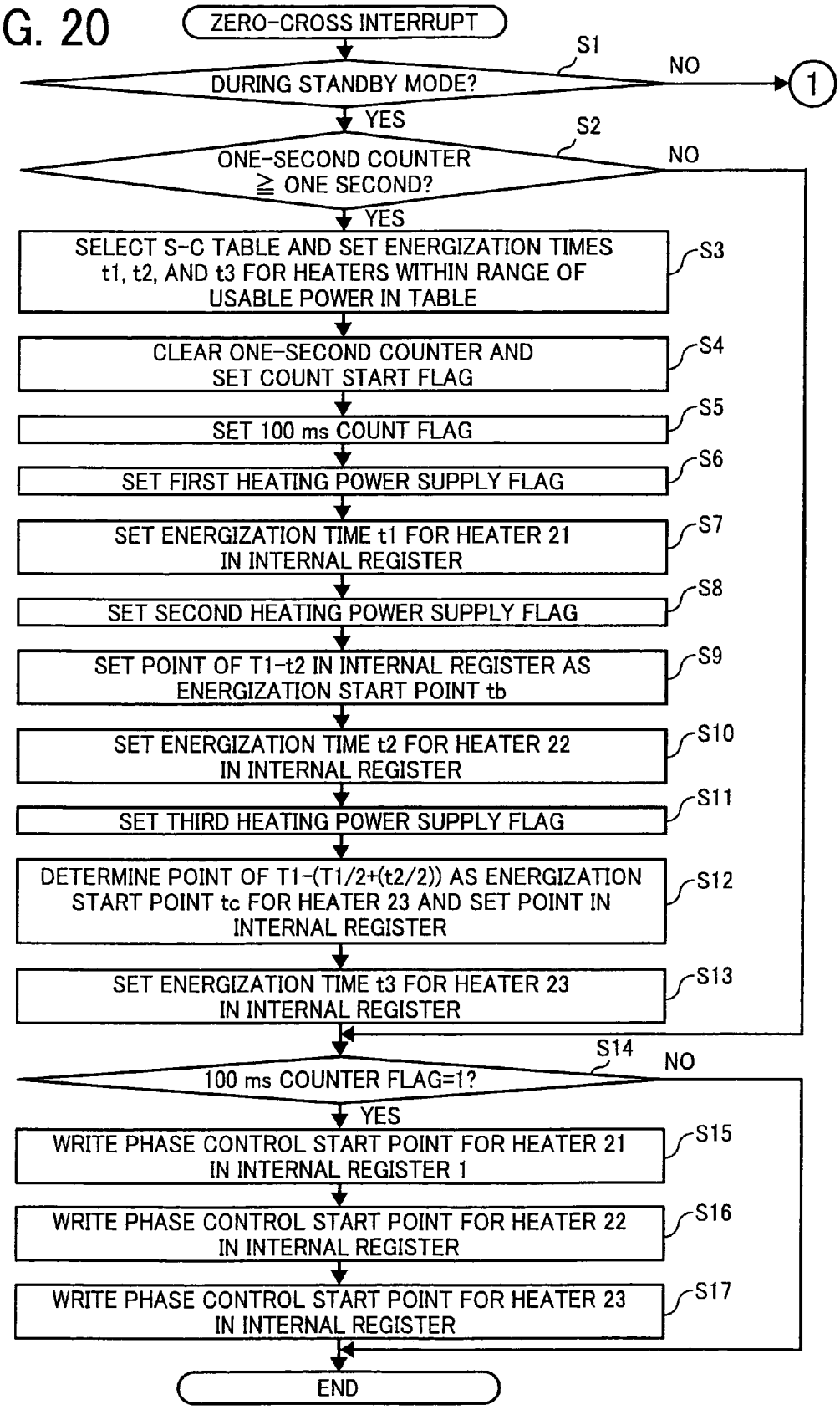
FIG. 20 is a flowchart of processing for a zero-cross interrupt by a CPU 90 of the control unit 9 shown in FIG. 5.
Figure 21:
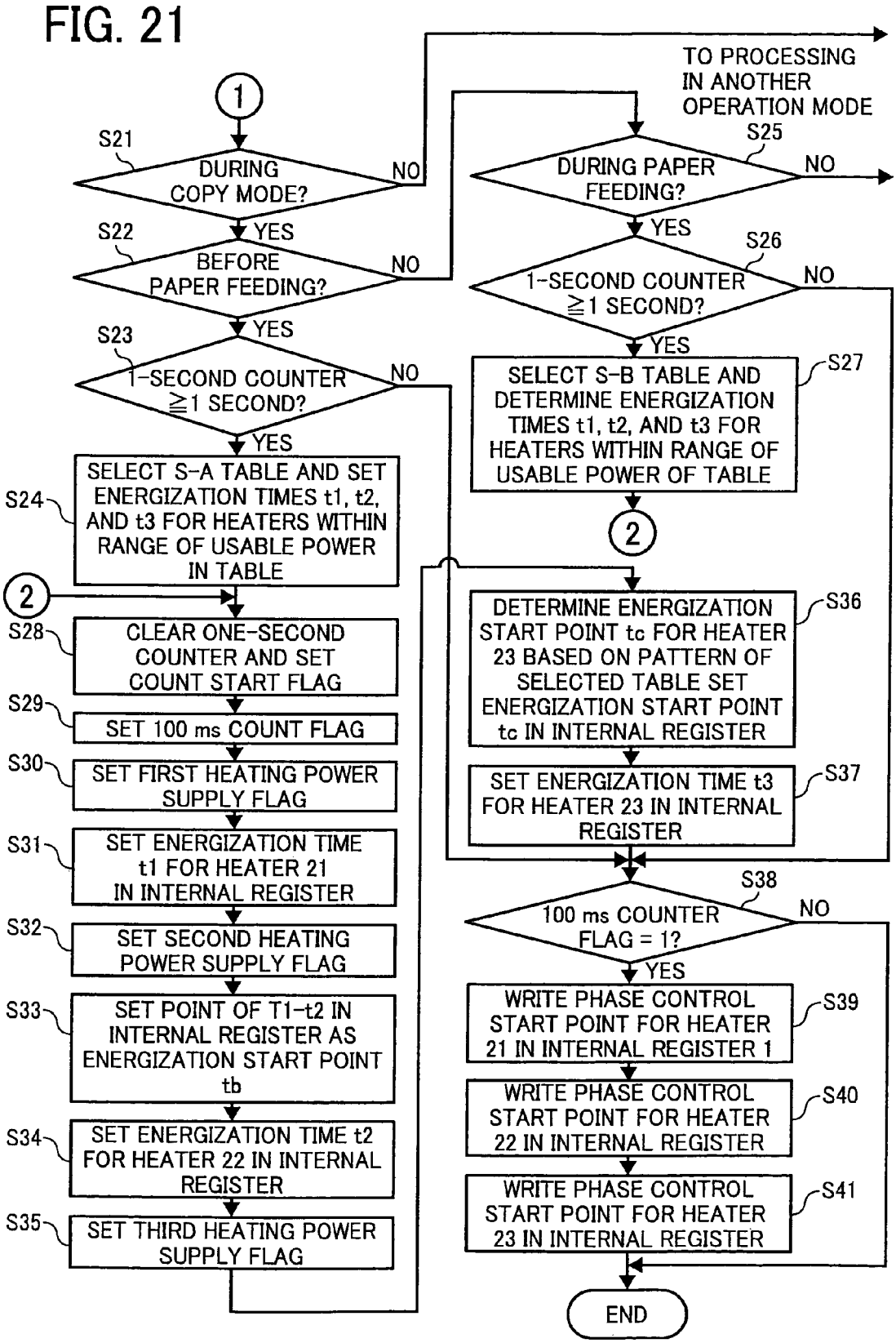
FIG. 21 is a flowchart following the flowchart shown in FIG. 20.

FIGS. 20 and 21 are a series of flowchart of zero-cross interrupt processing by the CPU 90 of the control unit 9 shown in FIG. 7. For convenience of illustration, the flowchart is divided into two figures. However, arrow lines indicated by encircled numbers are connected to each other.

This flowchart is a flowchart of processing for determining a duty (turn-on) for the supply of electric power to the heating means (the heaters 21, 22, and 23) within a predetermined control period according to an operation mode of the image forming apparatus. The flowchart is zero-cross interrupt processing executed every time a zero-cross signal is generated.

First, at Step S1 in FIG. 20, the CPU 90 checks whether the image forming apparatus is in the standby mode. As a result, when the image forming apparatus is not in the standby mode, the control unit proceeds to Step S21 in FIG. 21 and checks whether the image forming apparatus is in the copy mode.

When the image forming apparatus is in the standby mode at Step S1, the CPU 90 proceeds to Step S2 and judges whether time is equal to or larger than the control period T1 set in advance. In the case of this example, because the control period T1 is one second, the CPU 90 checks whether a one-second counter for counting one second is equal to or larger than one second. The one-second counter is counted in a timer interrupt routine explained later referring to FIGS. 22 and 23.

When the one-second counter is equal to or larger than one second at Step S2 in FIG. 20, the CPU 90 proceeds to Step S3, selects the usable S-C table, and sets turn-ons (duties) of the heaters within a range of usable electric power in the table.

In the case of this example, the CPU 90 sets the turn-ons (t1, t2, and t3) for the heaters based on the data of turn-on Duty of the S-C table shown in FIG. 15.

At Step S4, the CPU 90 clears the one-second counter and sets a count start flag used in the timer interrupt routine explained later. At Step S5, the CPU 90 sets a 100 mS count flag for performing phase control for a period of 100 mS for soft-start for preventing a rush current.

Thereafter, at Step S6, the CPU 90 sets a first heating power supply flag that indicates that the supply of electric power to the heating center heater 21 (the first heating means) is possible. At Step S7, the CPU 90 sets the turn-on t1 for the heater 21 calculated earlier in an internal register of the CPU 90.

At Step S8, the CPU 90 sets a second heating power supply flag that indicates that the supply of electric power to the heating end heater 22 (the second heating means) is possible. At Step S9, the CPU 90 sets, based on the control period T1 and the turn-on t2 for the heater 22 calculated earlier, a point of T1-t2 in the internal register of the CPU 90 as the turn-on start point tb. At Step S10, the CPU 90 sets the turn-on t2 for the heater 22 in the internal register.

At Step S11, the CPU 90 sets a third heating power supply flag that indicates that the supply of electric power to the pressing heater 23 (the third heating means) is possible. At Step S12, the CPU 90 sets, based on the control period T1 and the turn-on t2 for the heater 22 calculated earlier, a point of T−1(T1/2+(t2/2)) in the internal register as the turn-on start point tc for the heater 23. At Step S13, the CPU 90 sets the turn-on t3 for the heater 23 calculated earlier in the internal register of the CPU 90.

According to the series of operations, points (timings) for starting the supply of electric power to the heaters 21, 22, and 23 within the predetermined control period T1 and turn-ons for the heaters 21, 22, and 23 are determined.

The CPU 90 proceeds to Step S14 and checks whether the 100 mS counter is counted and the 100 mS flag is set ("1") in the timer interrupt routine explained later.

When the 100 mS flag is set, at Step S15, the CPU 90 writes a phase control start point for the heater 21, which is set according to a result of temperature detection for the heater 21 or set in advance, in an internal register 1. At Step S16, the CPU 90 writes a phase control start point for the heater 22, which is set according to a result of temperature detection for the heater 22 or set in advance, in an internal register 2.

At Step S17, the CPU 90 writes a phase control start point for the heater 23, which is set according to a result of temperature detection for the heater 23 or set in advance, in an internal register 3 and finishes the processing of this flow.

According to the series of operations, soft-start starting points in starting the supply of electric power to the heaters 21, 22, and 23 as the heating means are determined.

When the image forming apparatus is not in the copy mode at Step S21 in FIG. 21, the CPU 90 performs processing of not-shown another operation mode (e.g., the warm-up mode at the time when the power supply is turned on). When the image forming apparatus is in the copy mode, at Step S22, the CPU 90 checks whether the image forming apparatus is before paper feeding.

When the image forming apparatus is before paper feeding, at Step S23, the CPU 90 checks whether time is equal to or larger than the control period T1. In the case of this example, because the control period T1 is one second, the CPU 90 checks whether the one-second counter for counting one second is equal to or larger than one second. The one-second counter is counted in the timer interrupt routine explained later.

When the one-second counter is equal to or larger than one second, at Step S24, the CPU 90 selects the table S-A usable before paper feeding and sets the turn-ons (t1, t2, and t3) for the heaters based on data of the turn-on Duty within a range of usable power in the table.

When the image forming apparatus is not before paper feeding at Step S22, at Step S25, the CPU 90 checks whether the image forming apparatus is in paper feeding. As a result, when the image forming apparatus is not in paper feeding at Step S23, the CPU 90 performs processing of not-shown another operation mode (a mode after paper feeding, etc.). When the image forming apparatus is in paper feeding, at Step S26, as at Step S23, the CPU 90 checks whether the one-second counter is equal to or larger than one second.

When the one-second counter is equal to or larger than one second, at Step S27, the CPU 90 selects the table S-B usable during paper feeding and determines turn-ons (duties) for the heaters within a range of usable electric power of the table and based on a result of temperature detection for the heaters.

After determining the turn-ons (duties) for the heaters at Step S24 or S27, the CPU 90 executes processing at Steps S28 to S41. However, because the processing at these steps is the same as the processing at Steps S4 to S11 and Steps S13 to S17 explained referring to FIG. 20 except Step S36, explanation of the processing is omitted. At Step S36, the CPU 90 determines the turn-on start point tc for the heater 23 as the third heating means based on a pattern of turn-on according to the selected table (the S-A table shown in FIG. 15 or the S-B table shown in FIG. 16) and sets the turn-on start point tc in the internal register.

Because a method of determining the turn-on start point tc is explained above, explanation of the method is omitted.

When the one-second counter is not equal to or larger than one second at Step S23 or S26, the CPU 90 proceeds to Step S38, executes the processing at Steps S38 to S41, and finishes the processing. The processing is the same as the processing at Steps S14 to S17 explained referring to FIG. 20.

Figure 22:
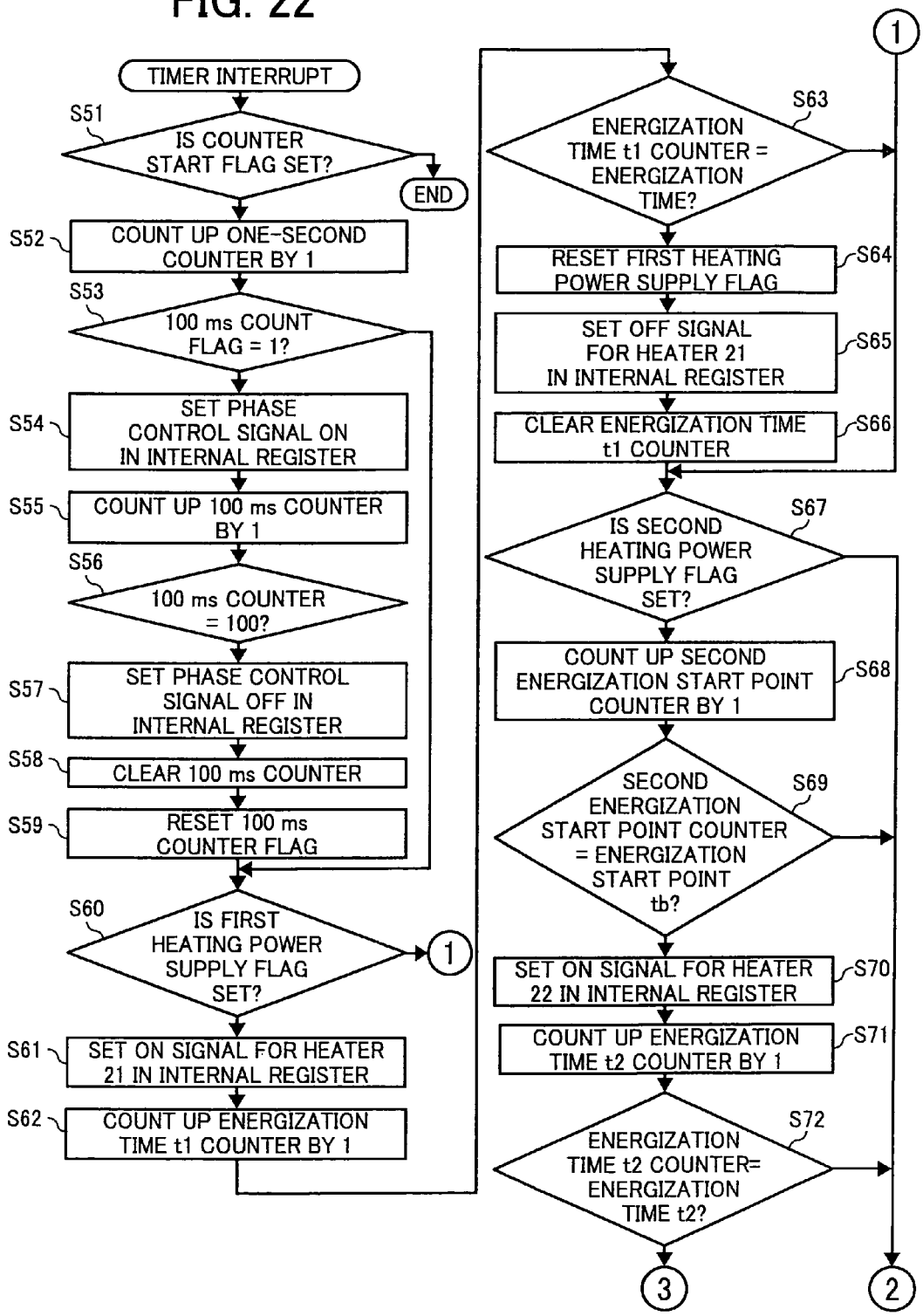
FIG. 22 is a flowchart of processing for a timer interrupt by the CPU 90 of the control unit 9 shown in FIG. 5.
Figure 23:
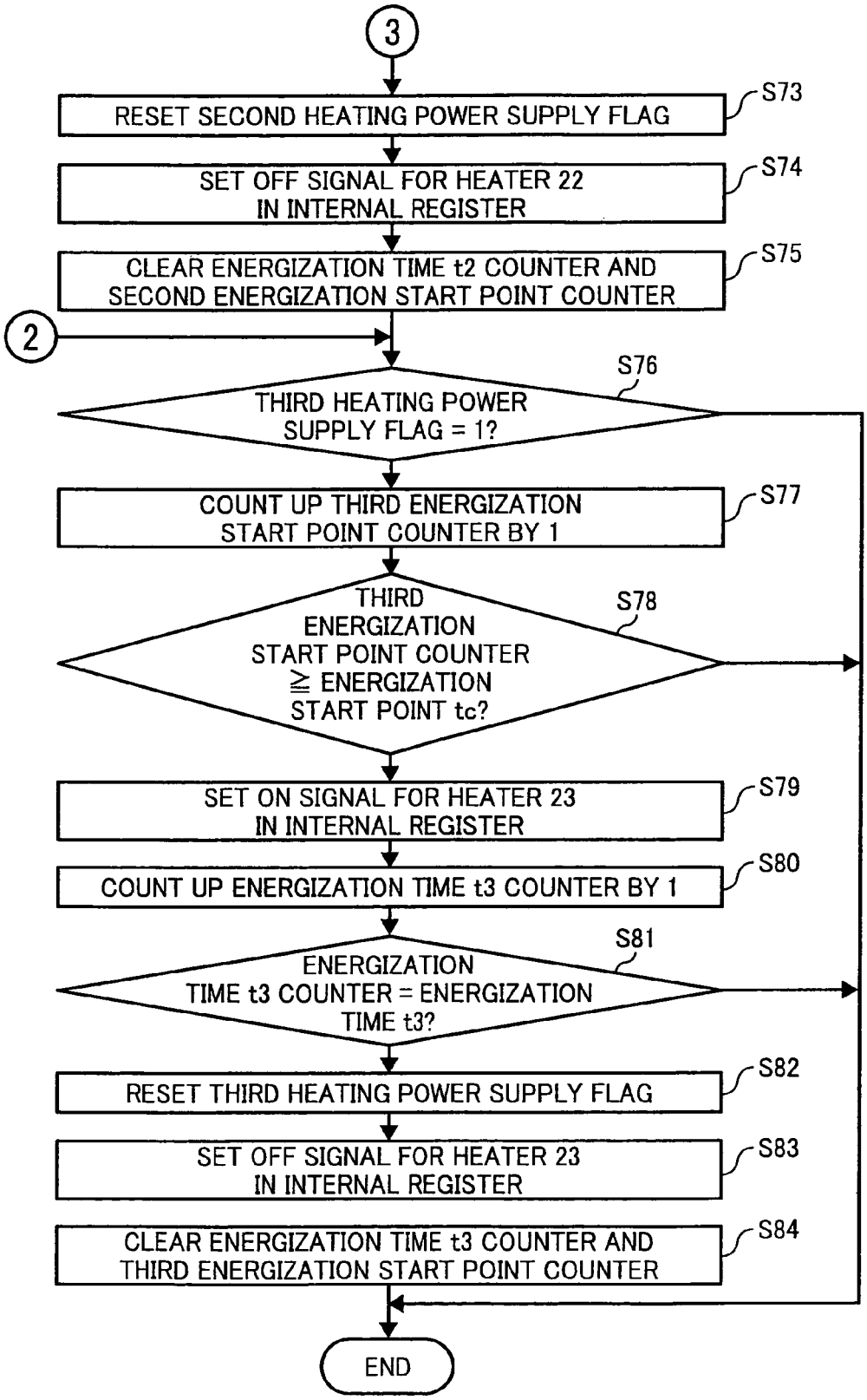
FIG. 23 is a flowchart following the flowchart shown in FIG. 22.

FIGS. 22 and 23 are a series of flowchart of timer interrupt processing by the CPU 90 of the control unit 9 shown in FIG. 7, i.e., processing for generating timer interrupt at every fixed time and counting turn-ons and turn-on start points for the heaters. For convenience of illustration, the flowchart is divided into two figures. However, arrow lines indicated by encircled numbers are connected to each other.

First, at Step S51 in FIG. 22, the CPU 90 checks whether a counter start flag for permitting the start of various timer counters is set. When the counter start flag is not set, the CPU 90 finishes this processing.

When the counter start flag is set, at Step S52, the CPU 90 counts up a one-second counter for counting a fixed time by "1". The one-second counter is cleared in the zero-cross interrupt processing explained above when one or more seconds are counted (Step S4 in FIG. 20 or Step S28 in FIG. 21).

At Step S53, the CPU 90 checks whether the 100 mS count flag for counting 100 milliseconds in a period for phase control is set ("1"). When the 100 mS count flag is set, at Step S54, the CPU 90 sets a phase control signal ON in an internal register of the internal control circuit 98*c* shown in FIG. 8.

Thereafter, at Step S55, the CPU 90 counts up the 100 mS counter by "1". At Step S56, the CPU 90 checks whether the 100 mS counter has counted 100 mS.

When the 100 mS counter has counted 100 mS, because the phase control period is finished, at Step S57, the CPU 90 sets a phase control signal OFF in the internal register of the internal control circuit 98*c* shown in FIG. 8. At Step S58, the CPU 90 clears the 100 mS counter and, at Step S59, resets the 100 mS counter flag.

According to the series of operations, the phase control period signal Sp shown in (g) in FIG. 9 is output from the internal control circuit 98*c* shown in FIG. 8.

This operation is performed for each of the heaters. The circuit shown in FIG. 8 is provided for each of the heaters.

After resetting the 100 mS counter flag at Step S59 or when the 100 mS count flag is not set at Step S53 or when the 100 mS counter has not counted 100 milliseconds at Step S56, the CPU 90 proceeds to Step S60 and checks whether a first heating power supply flag is set.

When the first heating power supply flag is set, at Step S61, the CPU 90 sets an ON signal for supplying electric power to the heater 21 as the first heating means in the internal register of the internal control circuit 98*c* shown in FIG. 8. Subsequently, at Step S62, the CPU 90 counts up an turn-on t1 counter for counting time t1 for turning on the heater 21 by "1".

At Step S63, the CPU 90 checks whether the turn-on t1 counter has counted turn-on. The CPU 90 refers to a value of t1 written in the internal register in the zero-cross interrupt processing explained above. As a result, when the turn-on t1 counter has counted the turn-on t1, because the supply of electric power to the heater 21 is finished, the CPU 90 proceeds to Step S64 and resets the first heating power supply flag. Subsequently, at Step S65, the CPU 90 sets an OFF signal for stopping the supply of electric power to the heater 21 in the internal register of the internal control circuit 98*c* shown in FIG. 8. At Step S66, the CPU 90 clears the turn-on t1 counter.

After Step S66, or when the first heating power supply flag is not set at Step S60, or when the turn-on t1 counter has not counted turn-on at Step S63, the CPU 90 proceeds to Step S67 and checks whether a second heating power supply flag is set. As a result, when the second heating power supply flag is set, at Step S68, the CPU 90 counts up, by "1", a second turn-on start point counter for counting a point when turning on the heater 22 as the second heating means is started.

AT Step S69, the CPU 90 checks whether the second turn-on start point counter has counted the turn-on start point tb. The CPU 90 refers to a value of the turn-on start point tb written in the internal register in the zero-cross interrupt processing explained above. When the second turn-on start point counter has counted the turn-on start point tb, at Step S70, the CPU 90 sets an ON signal for supplying electric power to the heater 22 in the internal register of the internal control circuit 98*c* shown in FIG. 8.

Thereafter, at Step S71, the CPU 90 counts up an turn-on t2 counter for counting time t2 for turning on the heater 22 by "1".

Subsequently, at Step S72, the CPU 90 checks whether the turn-on t2 counter has counted the turn-on t2. The CPU 90 refers to a value of the turn-on t2 written in the internal register in the zero-cross interrupt processing explained above. As a result, when the turn-on t2 counter has counted the turn-on t2, because the supply of electric power to the heater 22 has finished, the CPU 90 proceeds to Step S73 in FIG. 23.

The CPU 90 resets the second heating power supply flag. At Step S74, the CPU 90 sets an OFF signal for stopping the supply of electric power to the heater 22 in the internal register of the internal control circuit 98*c* shown in FIG. 8.

At Step S75, the CPU 90 clears the turn-on t2 counter and the second turn-on start point counter.

After Step S75 or when a result of the check is NO at any one of Steps S67, S69, and S72, the CPU 90 proceeds to Step S76 and checks whether a third heating power supply flag is set. When the third heating power supply flag is set, at Step S77, the CPU 90 counts up a third turn-on start point counter for counting a point when turning on the heater 23 as the third heating means is started.

At Step S78, the CPU 90 checks whether the third turn-on start point counter has counted the turn-on start point tc. The CPU 90 refers to a value of the turn-on start point tc written in the internal register in the zero-cross interrupt processing. When the third turn-on start point counter has counted the turn-on start point tc, at Step S79, the CPU 90 sets an ON signal for supplying electric power to the heater 23 in the internal register of the internal control circuit 98*c* shown in FIG. 8. Thereafter, at Step S80, the CPU 90 counts up "1" turn-on t3 counter for counting time t3 for turning on the heater 23.

At Step S81, the CPU 90 checks whether the turn-on t3 counter has counted the turn-on t3. The CPU 90 refers to a value of the turn-on t3 written in the internal register in the zero-cross interrupt processing.

As a result, when the turn-on t3 counter has counted the turn-on t3, because the supply of electric power to the heater 23 is finished, the CPU 90 proceeds to Step S82 and resets the third heating power supply flag. At Step S83, the CPU 90 sets an OFF signal for stopping the supply of electric power to the heater 23 in the internal register of the internal control circuit 98*c* shown in FIG. 8.

Finally, at Step S84, the CPU 90 clears the turn-on t3 counter and the third turn-on start point counter and finishes the processing.

When a result of the check at any one of Steps S76, S78, and S81 is NO, the CPU 90 directly finishes the processing.

A fixing device of an image forming apparatus according to another embodiment of the present invention includes four heaters as heating means.

Figure 24:
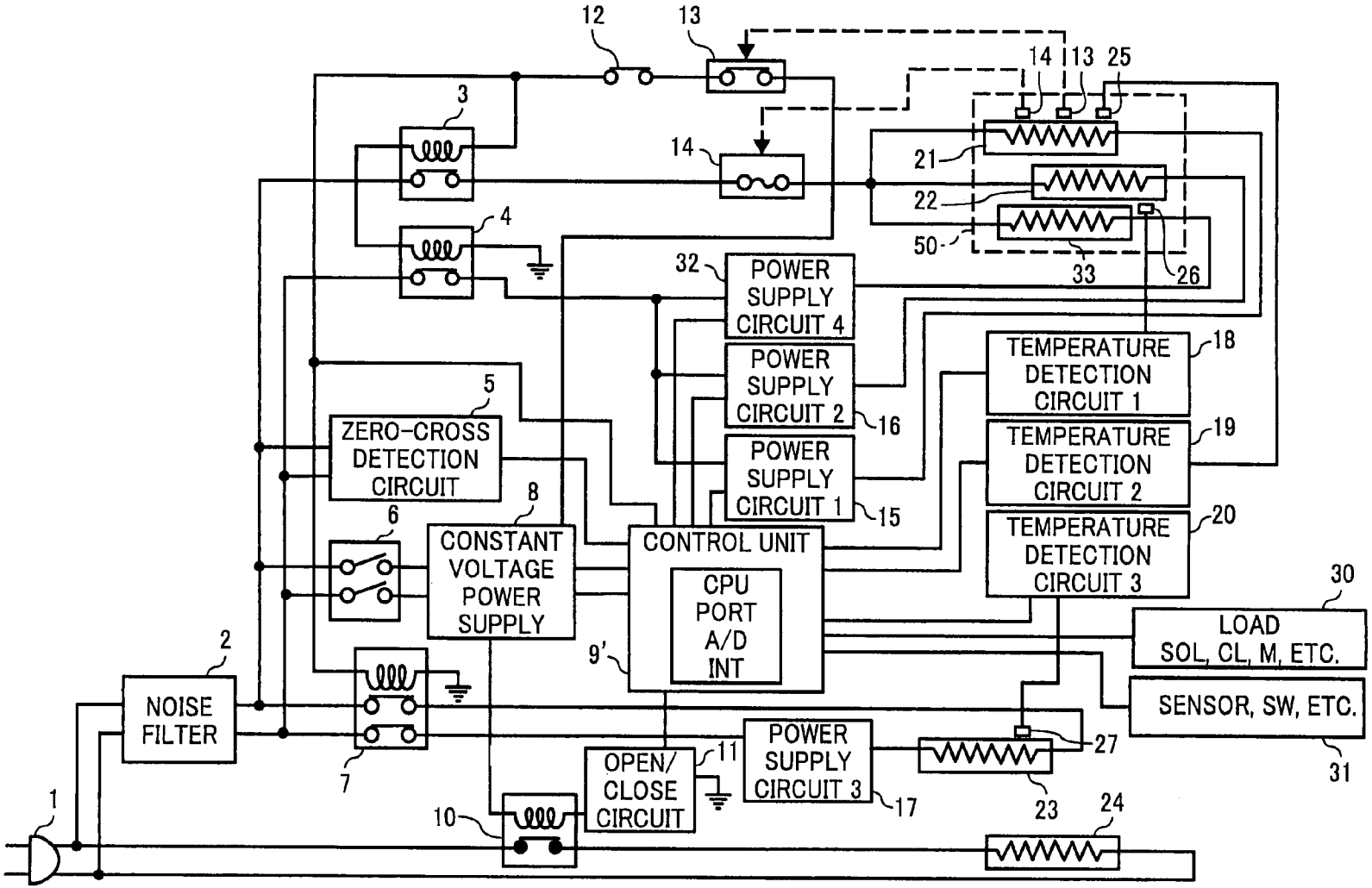
FIG. 24 is a diagram of an AC power control circuit of an image forming apparatus according to another embodiment of the present invention.

FIG. 24 is a diagram of an AC power control circuit according to the embodiment. The AC power control circuit shown in FIG. 24 is substantially the same as the AC power control circuit shown in FIG. 3 according to the embodiment explained above. Components corresponding to the AC power control circuit shown in FIG. 3 are denoted by the same reference numerals and signals and explanation of the components is omitted.

The AC power control circuit shown in FIG. 24 is different from the AC power control circuit shown in FIG. 3 in that the heating auxiliary heater 33 indicated by an imaginary line is provided in the heating roller 55 shown in FIG. 4 configuring the fixing device 50 and a power supply circuit 32 that supplies electric power to the heating auxiliary heater 33 is provided. Consequently, because a control unit 9' controls the power supply circuit 32 as well, the control unit 9' has functions slightly different from those of the control unit 9 in the embodiment explained above. However, the control unit 9' has all the functions of the control unit 9.

When the heating auxiliary heater 33 is turned on and supplies electric power in the same control period together with the three heaters explained above, the heating auxiliary heater 33 is set as fourth heating means having power consumption (e.g., 200 watts) smaller than that of the second heating means (the pressing heater 23). Like the tables shown in FIGS. 15 to 17, a plurality of kinds of tables including data of an turn-on ratio (turn-on Duty) with respect to the control period T1 of the heating auxiliary heater 33 and a table indicating information concerning a correspondence relation between operation modes of the image forming apparatus and the tables are stored in a memory of the control unit 9'.

First, the control unit 9' sets the control period T1 and, as explained referring to FIGS. 10 to 13 and FIGS. 15 to 19 in the embodiment explained above, selects a table corresponding to an operation mode, sets turn-ons t1, t2, t3, and t4 for the heating means within a range of usable power referring to the data of turn-on Duty for the heating means, and determines the turn-on start point tc for the heating means and turn-on start point td for the fourth heating means.

Power supply patterns corresponding to FIGS. 10 to 13 in that case are shown in FIGS. 25 to 28.

In this case, as in the case explained above, the first heating means is always turned on from a point in the beginning of the control period T1 and the second heating means is always started to be turned on from a point obtained by subtracting the turn-on t2 from the end of the control period T (tb=T1−t2). As explained above, the turn-on start point tc for the third heating means is determined by selecting any one of the four kinds of power supply patterns (a) to (d) based on a relation between the control period T1 and the turn-ons t1, t2, and t3 for the first heating means, the second heating means, and the third heating means.

The turn-on start point td for starting the supply of electric power to the fourth heating means is determined such that the turn-on (the power supply time) t4 for the fourth heating means does not overlap time for supplying electric power to all of the first heating means, the second heating means, and the third heating means in parallel within the control period T1 and, when the overlap cannot be completely prevented, the overlapping time is minimized.

Figure 25:
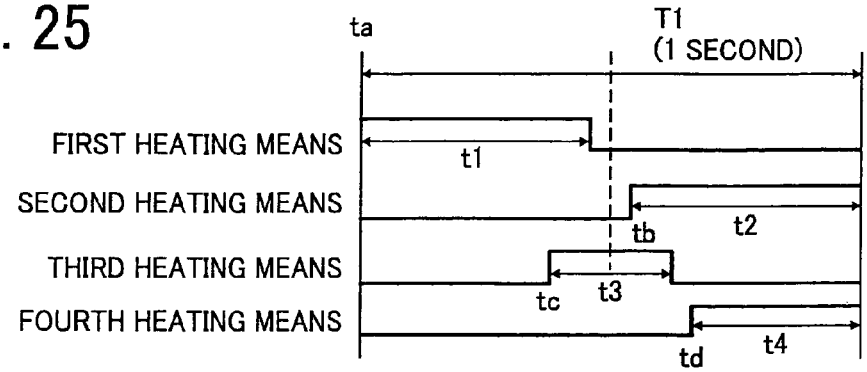
FIG. 25 is a timing chart of a first power supply pattern in supplying electric power to four heating means having different power consumptions within a control period set by a control unit 9' shown in FIG. 24.
Figure 26:
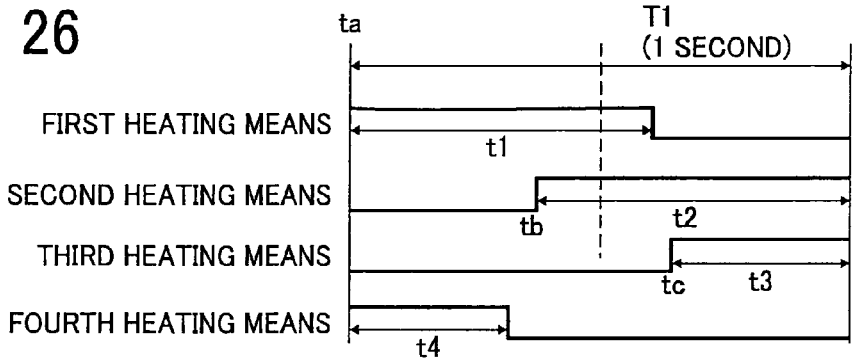
FIG. 26 is a timing chart of a second power supply pattern in supplying electric power.
Figure 27:
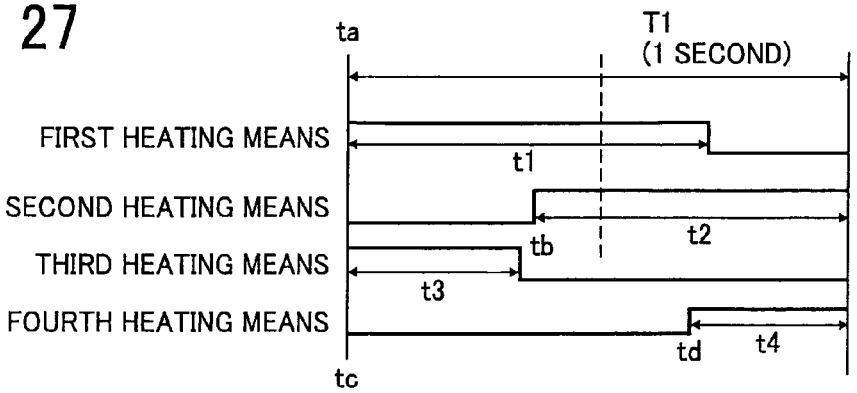
FIG. 27 is a timing chart of a third power supply pattern in supplying electric power.
Figure 28:
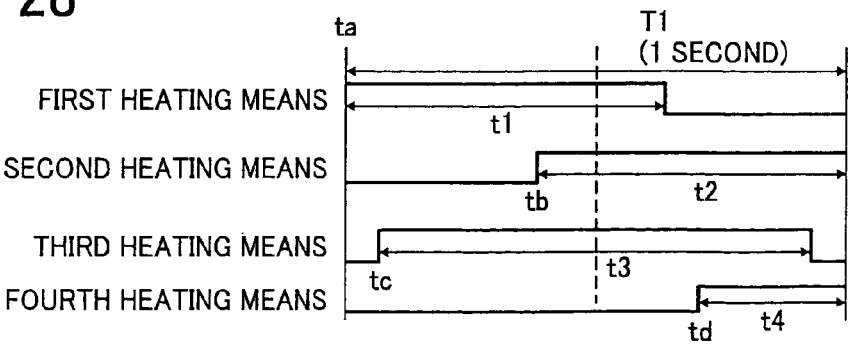
FIG. 28 is a timing chart of a fourth power supply pattern in supplying electric power.

Therefore, when the turn-on start point tc when the supply of electric power to the third heating means is started is determined according to (b) explained above, as shown in FIG. 26, it is advisable to determine the beginning of the control period T1 or a point slightly delayed from the beginning as the turn-on start point td for the fourth heating means. When the turn-on start point tc for the third heating means is determined according to any one of (a), (c), and (d) explained above, it is advisable to determine a point obtained by subtracting the power supply time t4 for the fourth heating means from the end of the control period T1 as the turn-on start point td for the fourth heating means as shown in FIGS. 25, 27, and 28.

Electric power is supplied to the fourth heating means for a period of the turn-on t4 from the turn-on start point td within a control period same as that for the power supply control for the first, second, and third heating means.

As another power supply control method in the AC power control circuit shown in FIG. 24, a method of use explained below is also possible.

For example, the added heating auxiliary heater 33 is not used as the forth heating means but used in place for the heating center heater 21 or the heating end heater 22 as, for example, a heating of about 400 watts.

As an example of operation modes of the heating auxiliary heater 33, the heating auxiliary heater 33 is fully turned on and used in place of the heating center heater (700 W) 21 during standby and used in place of the heating end heater (600 W) during warm-up for fixing.

In this case, the control unit 9' does not perform power supply control for the heating center heater 21 or the heating end heater 22. Instead, the control unit 9' causes the power supply circuit 32 to supply electric power to the heating auxiliary heater 33.

For example, when electric power is supplied to the heating auxiliary heater 33 instead of the heating center heater 21, with the heating end heater 22 set as the first heating means, the heating auxiliary heater 33 set as the second heating means, and the pressing heater 23 set as the third heating means, the power supply control according to the present invention explained above can be applied to the three heating means.

When electric power is supplied to the heating auxiliary heater 33 instead of the heating end heater 22, with the heating center heater 21 set as the first heating means, the heating auxiliary heater 33 set as the second heating means, and the pressing heater 23 set as the third heating means, the power supply control according to the present invention explained above can be applied to the three heating means.

As described above, when the power supply control for a plurality of heating means of the fixing device is performed according to the present invention, the first, second, and third heating means and the like are not fixedly determined. A plurality of heating means (heaters), to all of which electric power is actually supplied, are simply set as the first heating means, the second heating means, the third heating means, and the like in order from one with the largest power consumption within a control period set by the control unit. If heating means to which electric power is actually supplied are changed within the control period, targets and orders of the heating means are changed.

As described above, since the heating auxiliary heater 33 is provided, selectable forms of a method of supplying electric power to the fixing device increases and the effect of carrying out the present invention is improved.

According to the embodiments of the present invention explained above, it is possible to always perform optimum supply of electric power to each of a plurality of heaters according to an operation mode of the image forming apparatus within electric power usable in the fixing device and suppress non-uniformity of temperature in heating units.

In other words, it is possible to drive each of the heaters t an optimum turn-on width (turn-on time) according to electric power usable for heater driving and a mode of the image forming apparatus.

Consequently, it is possible to provide an image forming apparatus with an improved copy quality and power consumption of which does not exceed the rated power of the commercial power supply.

It is possible to stabilize the supply of electric power to the fixing device and minimize occurrence of flicker, harmonic distortion, and terminal noise.

It is possible to further suppress occurrence of flicker, harmonic distortion, and terminal noise by starting the supply of electric power to the heaters at the zero-cross time.

It is possible to diversify a method of supplying electric power to the fixing device by providing an auxiliary heater.

With the image forming apparatus and the control method therefor according to the present invention, in the image forming apparatus including the fixing device having a plurality of heating units (heaters), electric power is prevented from being simultaneously supplied to the heating units within a control period or time for simultaneously supplying electric power is minimized and electric power supplied to the heating units within the control period is equalized. This makes it possible to effectively suppress fluctuation in a power supply voltage and prevent or minimize occurrence of ripple, flicker, and the like.

Figure 1:
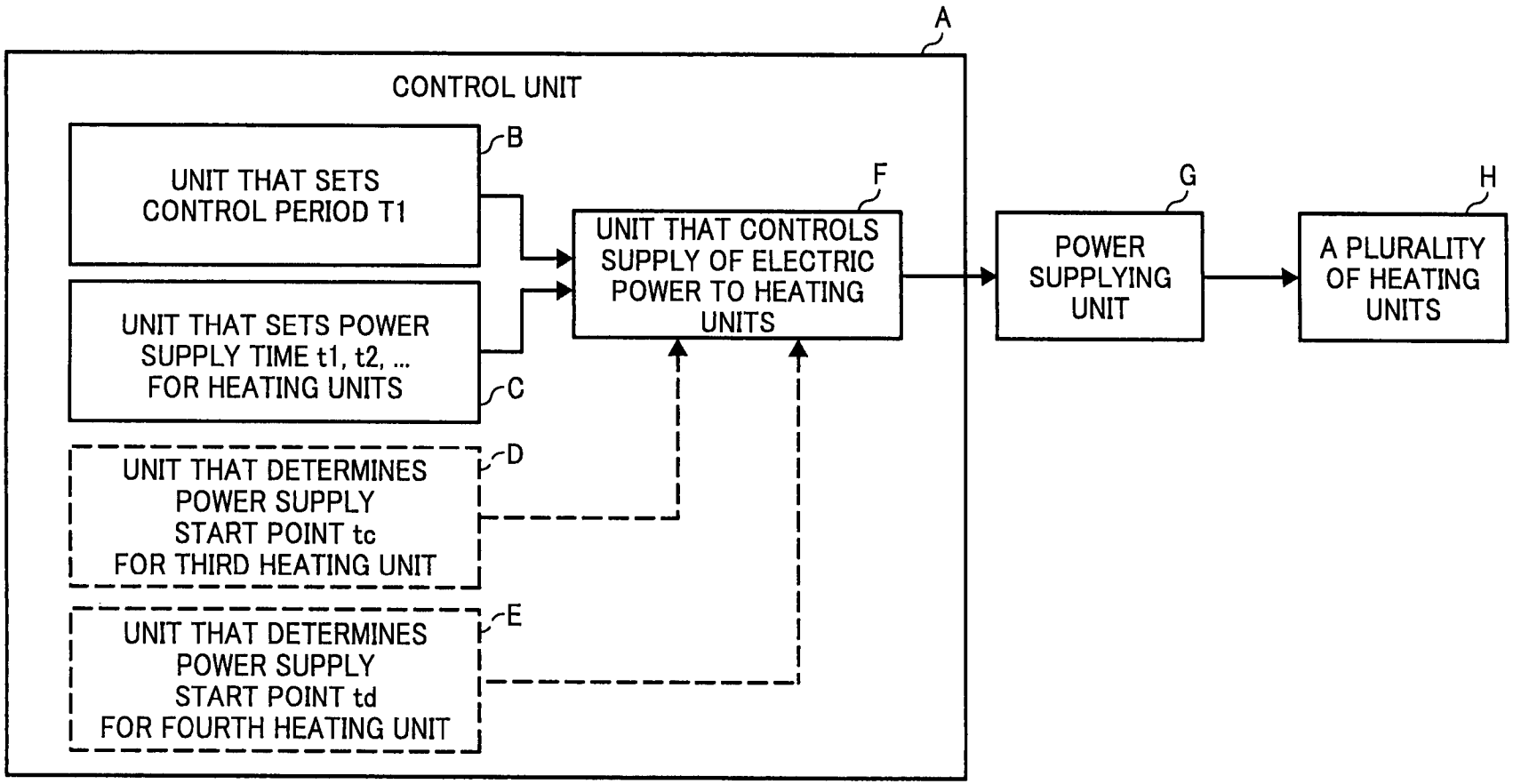
FIG. 1 is a functional block diagram of a basic configuration of an image forming apparatus according to the present invention.
Figure 2:
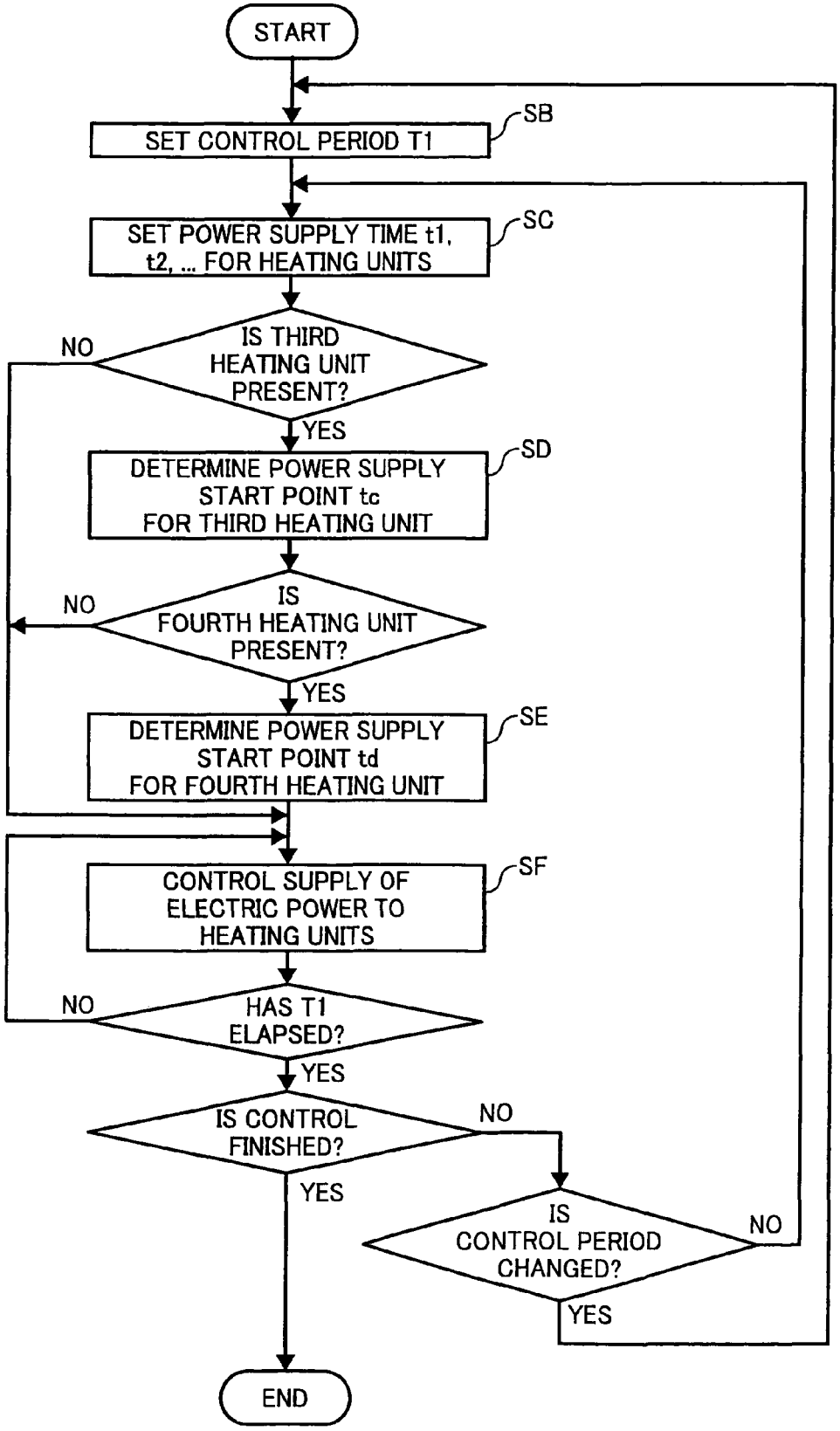
FIG. 2 is a flowchart of a flow of basic processing of a control method for the image forming apparatus according to the present invention.

In the flowchart shown in FIG. 2, the control at Step SF is continues until the control period T1 elapses after the power supply control in this control period is started. When the control period T1 elapses, the control unit judges whether the control is finished. When the control is finished, the control unit finishes this processing. However, when the control is not finished, the control unit judges whether it is necessary to change the control period. When it is unnecessary to change the control period, the control unit returns to Step SC and repeats the processing at Step SC and subsequent steps. When it is necessary to change the control period, the control unit returns to Step SB, sets the control period T1 again, and repeats the processing at subsequent steps.

The order of the respective heating units is not fixedly determined. A plurality of heating means, to all of which electric power is supplied, are simply given numbers in such a manner as first, second, and third in order from one with the largest power consumption in a certain control period. Therefore, even if heating means is physically provided, the heating means is not included in these heating means unless the heating means is used in the control period. When there are a plurality of heating means with the same level of power consumption, whichever one may be given a smaller number.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a fixing device to fix a toner image formed on a medium by applying pressure and heat onto the medium, the fixing device including a plurality of heating units having different power consumptions;

a power supplying unit to supply a power to each of the plurality of heating units; and a control unit to control a supply of the power to the plurality of heating units by the power supplying unit at a control period T1, the control unit including, a first unit to set the control period T1, a second unit to set a power supply time t1 for a first heating unit having a largest power consumption among the plurality of heating units to which the power is supplied within the control period T1 and a power supply time t2 for a second heating unit having a second largest power consumption of the plurality of heating units, a third unit to supply the power to the first heating unit for a first period of the power supply time t1, the first period being from a beginning of the control period T1, and to supply the power to the second heating unit for a second period, the second period being from a point obtained by subtracting the power supply time t2 from an end of the control period T1, a fourth unit to set a power supply time t3 for a third heating unit, the third heating unit having a power consumption third largest next to the second heating unit, and a fifth unit to determine a point tc to start a supply of the power to the third heating unit such that at least one of the power supply time t3 does not overlap with both power supply time t1 and power supply time t2 within the control period T1 and minimizing the overlap of the power supply time t3 with both power supply time t1 and power supply time t2 within the control period T1.

2. The image forming apparatus according to claim 1, wherein, $t1+t2 \leqq T1$ in a first relationship, the fifth unit is configured to set the point tc by subtracting $T1/2+t3/2$ from the end of the control period T1, if $t1+t2>T1$ and $T1-t1 \geqq t3$ in a second relationship, the fifth unit is configured to set the point tc by subtracting the power supply time t3 from the end of the control period T1, and if $t1+t2>T1$ and $T1-t2 \geqq t3$ in a third relationship, the fifth unit is configured to set the point tc as the beginning of the control period T1 or a point delayed from the beginning of the control period T1 by a predetermined time, and if none of the above relationships applies, in a fourth relationship the fifth unit is configured to set the point tc by subtracting $T1/2+t3/2$ from the end of the control period T1.

3. The image forming apparatus according to claim 2, wherein the control unit further includes, a sixth unit to set a power supply time t4 for a fourth heating unit having a power consumption fourth largest next to the third heating unit, and a seventh unit to a point td to start a supply of the power to the fourth heating unit, if the fifth unit determines the point tc according to the second relationship, the seventh unit is configured to set the point td at the beginning of the control period T1 or a point delayed from the beginning of the control period T1 by a predetermined time, and if the fifth unit determines that the point tc according to any one of first, third, and fourth relationships, the seventh unit is configured to set the point td by subtracting the power supply time t4 from the end of the control period T1.

4. The image forming apparatus according to claim 1, wherein the control unit further includes:

a sixth unit to set a power supply time t4 for a fourth heating unit having a power consumption fourth largest next to the third heating unit, and a seventh unit to determine a point td to start a supply of the power to the fourth heating unit such that at least one of the power supply time t4 does not overlap with times for supplying the power to all of the first heating unit, the second heating unit, and the third heating unit in parallel within the control period T1 and minimizing an overlap of the power supply time t4 supplying the power to all of the first heating unit, the second unit, and the third heating unit in parallel within the control period T1.

5. The image forming apparatus according to claim 1, wherein the first, second, third, fourth and fifth units that sets the power supply times for the plurality of heating units in the control unit set the power supply times for the plurality of heating units within a range of usable power corresponding to an operation mode of the image forming apparatus.

6. The image forming apparatus according to claim 5, wherein the control unit further includes a plurality of tables in which, for each usable power, data of ratios of respective power supply times for the heating units to which the power is supplied within the control period T1 to the control period T1 are stored, and the first, second, third, fourth and fifth units that sets the power supply times for the plurality of heating units in the control unit set the power supply times for the heating units based on one of the tables according to the operation mode.

7. The image forming apparatus according to claim 1, further comprising:

a temperature detecting unit to detect temperature of each of the plurality of heating units, wherein the first, second, third, fourth and fifth units that sets the power supply times for the plurality of heating units in the control unit set the power supply times for the heating units within a range of usable power corresponding to an operation mode of the image forming apparatus and the temperature detected by the temperature detecting unit.

8. The image forming apparatus according to claim 7, wherein the control unit further includes a plurality of tables in which, for each usable power, data of ratios of respective power supply times for the plurality of heating units to which the power is supplied within the control period T1 to the control period T1 are stored, and the first, second, third, fourth and fifth units that sets the power supply times for the plurality of heating units in the control unit set the power supply times for the plurality of heating units based on one of the tables according to the operation mode.

9. The image forming apparatus according to claim 1, wherein the power supplied to the plurality of heating units is an alternate-current power, the image forming apparatus further includes a zero-cross detection circuit to detect a zero-cross point of the alternating-current power, and generates a zero-cross signal, and the first unit sets the control period T1 with the zero-cross signal generated by the zero-cross detection circuit as a reference.

10. An image forming apparatus according to claim 1, wherein the power supplying unit includes a fourth unit that controls a conduction angle for each of half-waves of the alternating-current power supplied to the plurality of heating units, and the control unit further includes a fifth unit that controls, when the power is supplied to the plurality of heating units, a phase of the conduction angle and soft-starts the heating units in a predetermined period from a power-supply start point.

11. A method of controlling a supply of power to a plurality of heating units having different power consumptions in a fixing device that fixes a toner image formed on a medium by applying pressure and heat onto the medium, the method comprising:

setting a control period T1 for controlling the supply of the power to the plurality of heating units;

setting a power supply time t1 for a first heating unit having a largest power consumption among the plurality of heating units to which the power is supplied within the control period T1 and a power supply time t2 for a second heating unit having a second largest power consumption; and controlling including, supplying the power to the first heating unit for a period of the power supply time t1 from beginning of the control period T1, and supplying the power to the second heating unit for a period from a point obtained by subtracting the power supply time t2 from an end of the control period T1, supplying the power to a third heating unit for a power supply time t3, the third heating unit having a power consumption third largest next to the second heating unit determining a point tc to start a supply of the power to the third heating unit such that at least one of the power supply time t3 does not overlap with both the power supply time t1 and the power supply time t2 within the control period T1 and minimizing the overlap of the power supply time t3 with both power supply time t1 and power supply time t2 within the control period T1.

* * * * *